US008872442B2

(12) United States Patent
Fushimi

(10) Patent No.: US 8,872,442 B2
(45) Date of Patent: Oct. 28, 2014

(54) ILLUMINATION SYSTEM

(71) Applicant: Panasonic Corporation, Osaka (JP)

(72) Inventor: Shigemi Fushimi, Osaka (JP)

(73) Assignee: Panasonic Corporation, Osaka (JP)

( * ) Notice: Subject to any disclaimer, the term of this patent is extended or adjusted under 35 U.S.C. 154(b) by 196 days.

(21) Appl. No.: 13/692,175

(22) Filed: Dec. 3, 2012

(65) Prior Publication Data

US 2013/0141011 A1 Jun. 6, 2013

(30) Foreign Application Priority Data

Dec. 6, 2011 (JP) ..... 2011-266418

(51) Int. Cl.
*H05B 37/02* (2006.01)

(52) U.S. Cl.
CPC ..... *H05B 37/02* (2013.01); *H05B 37/0272* (2013.01); *H05B 37/029* (2013.01)
USPC ..... 315/294; 315/149

(58) Field of Classification Search
CPC ..... H05B 37/02; H05B 37/0272
USPC ..... 315/149, 294, 312
See application file for complete search history.

(56) References Cited

U.S. PATENT DOCUMENTS

| | | | | |
|---|---|---|---|---|
| 2005/0231134 | A1* | 10/2005 | Sid | 315/294 |
| 2008/0203928 | A1 | 8/2008 | Frumau et al. | |
| 2008/0315798 | A1 | 12/2008 | Diederiks et al. | |
| 2008/0316730 | A1 | 12/2008 | Diederiks et al. | |
| 2009/0002981 | A1 | 1/2009 | Knibbe | |
| 2010/0090619 | A1 | 4/2010 | Adamson et al. | |
| 2010/0225241 | A1 | 9/2010 | Maehara et al. | |
| 2012/0235579 | A1* | 9/2012 | Chemel et al. | 315/152 |
| 2012/0293075 | A1* | 11/2012 | Engelen et al. | 315/151 |

FOREIGN PATENT DOCUMENTS

| | | |
|---|---|---|
| JP | 2008-537307 | 9/2008 |
| JP | 2009-521089 | 5/2009 |
| JP | 2009-521090 | 5/2009 |
| JP | 2009-521091 | 5/2009 |
| JP | 2010-510620 | 4/2010 |
| JP | 2010-176986 | 8/2010 |
| WO | 03/078894 | 9/2003 |
| WO | 2006/111927 | 10/2006 |
| WO | 2006/111930 | 10/2006 |
| WO | 2008/001277 | 1/2008 |
| WO | 2008/038180 | 4/2008 |
| WO | 2008/093266 | 8/2008 |

OTHER PUBLICATIONS

European Search Report for corresponding European Search Report No. 12008139.3-1239 dated Feb. 6, 2013.

* cited by examiner

*Primary Examiner* — Don Le
(74) *Attorney, Agent, or Firm* — Renner, Otto, Boisselle & Sklar, LLP

(57) ABSTRACT

An illumination system includes: a plurality of lighting devices; a control device for controlling the lighting devices; and a remote controller for remotely setting a control content to be performed by the control device. The remote controller includes: a light property setting unit for setting a light property of a control target lighting device; a pointer for emitting visible light to point the target lighting device; a projection position acquiring unit acquiring a projection position of the visible light; and a remote controller transmitting unit for wirelessly transmitting the property information indicative of the light property and the projection position information.

10 Claims, 16 Drawing Sheets

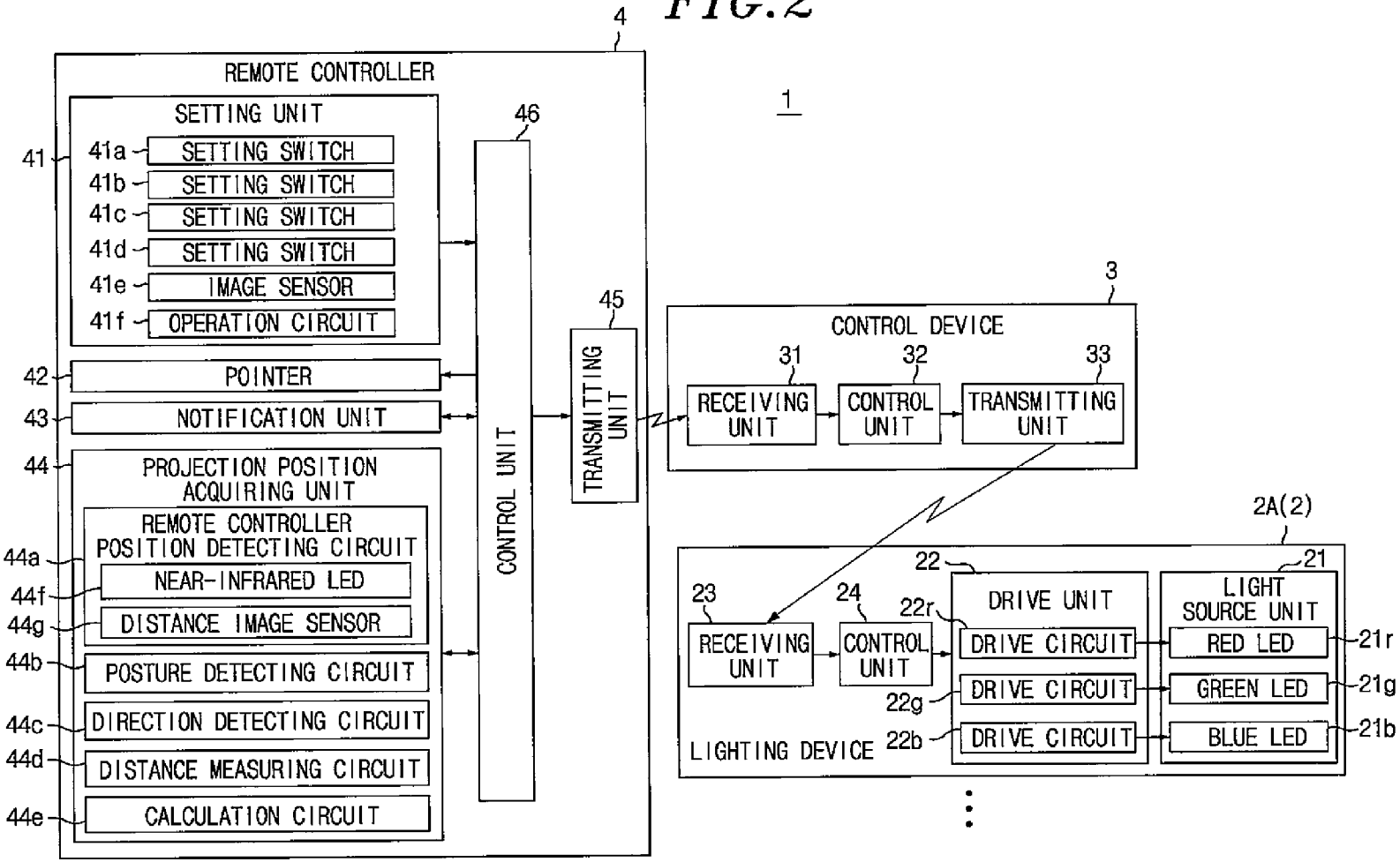
FIG. 2
1
4
REMOTE CONTROLLER
SETTING UNIT
SETTING SWITCH
SETTING SWITCH
SETTING SWITCH
SETTING SWITCH
IMAGE SENSOR
OPERATION CIRCUIT
41a
41b
41c
41d
41e
41f
41
POINTER
42
NOTIFICATION UNIT
43
PROJECTION POSITION ACQUIRING UNIT
44
REMOTE CONTROLLER POSITION DETECTING CIRCUIT
NEAR-INFRARED LED
DISTANCE IMAGE SENSOR
POSTURE DETECTING CIRCUIT
DIRECTION DETECTING CIRCUIT
DISTANCE MEASURING CIRCUIT
CALCULATION CIRCUIT
44a
44f
44g
44b
44c
44d
44e
46
CONTROL UNIT
45
TRANSMITTING UNIT
3
CONTROL DEVICE
31
RECEIVING UNIT
32
CONTROL UNIT
33
TRANSMITTING UNIT
2A(2)
LIGHTING DEVICE
23
RECEIVING UNIT
24
CONTROL UNIT
22
DRIVE UNIT
DRIVE CIRCUIT
DRIVE CIRCUIT
DRIVE CIRCUIT
22r
22g
22b
21
LIGHT SOURCE UNIT
RED LED
GREEN LED
BLUE LED
21r
21g
21b

ILLUMINATION SYSTEM

FIELD OF THE INVENTION

The present invention relates to an illumination system provided with a controller for controlling a plurality of lighting devices pursuant to control contents set by a remote controller.

BACKGROUND OF THE INVENTION

There is conventionally known an illumination system including a plurality of light sources, a remote control device for controlling the light sources and a sensor for detecting the position of the remote control device. The illumination system is configured to turn on the light source closest to the remote control device among the light sources (see, e.g., Japanese Application Publication No. 2009-521089).

In case where the aforementioned illumination system is applied to an illumination system for controlling a plurality of lighting devices arranged on a ceiling, it is necessary to move the remote control device near a desired lighting device in order to operate the desired lighting device. As a consequence, time is required to operate the lighting device. In particular, when there exists a plurality of lighting devices to be operated, the operation thereof becomes complex and the usability grows worse.

SUMMARY OF THE INVENTION

In view of the above, the present invention provides an illumination system capable of easily operating a plurality of lighting devices and having improved usability.

In accordance with the embodiment of the present invention, there is provided an illumination system, including: a plurality of lighting devices; a control device for controlling the lighting devices; and a remote controller for remotely setting a control content to be performed by the control device. The remote controller has: a light property setting unit for setting a light property of a control target lighting device among the lighting devices; a pointer for emitting visible light to illuminate and point the control target lighting device, a projection position acquiring unit acquiring projection position information indicative of a projection position of the visible light emitted from the pointer; and a remote controller transmitting unit for wirelessly transmitting the property information indicative of the light property set by the light property setting unit and the projection position information acquired by the projection position acquiring unit to the control device.

The control device has: a control device receiving unit for receiving the property information and the projection position information wirelessly transmitted from the remote controller transmitting unit; a lighting device selecting unit for selecting the control target lighting device based on the projection position information received by the control device receiving unit and the lighting device position information acquired in advance; and a control device transmitting unit for transmitting the property information received by the control device receiving unit to the control target lighting device selected by the lighting device selecting unit.

Each of the lighting devices has: a lighting device receiving unit for receiving the property information transmitted from the control device transmitting unit; and a lighting device control unit for controlling a light source of each of the lighting devices based on the property information received by the lighting device receiving unit.

The light property setting unit preferably has an imaging unit for imaging a sample having a light property or an information code indicative of a light property. The light property setting unit may be configured to obtain the light property by analyzing an image obtained by the imaging unit and to set the obtained light property as the light property of the control target lighting device.

At least one of the lighting devices preferably includes a lighting device transmitting unit for wirelessly transmitting current property information indicative of a current light property of said at least one of the lighting devices to the remote controller. The remote controller may include a remote controller receiving unit for receiving the current property information wirelessly transmitted from the lighting device transmitting unit. The light property setting unit may be configured to set the light property indicated by the current property information received by the remote controller receiving unit as a light property of another control target lighting device.

The remote controller may further include a setting adjustment unit for adjusting the content of the light property set by the light property setting unit.

The projection position acquiring unit may have: a remote controller position detecting unit for detecting the position of the remote controller; a direction detecting unit for, based on the posture of the remote controller, detecting the emission direction of the visible light emitted from the pointer; and a distance measuring unit for, based on the light reflected from a projection object of the visible light, measuring a distance from the remote controller to the projection position of the visible light. The projection position acquiring unit may be configured to recognize a position which is moved forward from the position of the remote controller detected by the remote controller position detecting unit in the emission direction detected by the direction detecting unit by the distance measured by the distance measuring unit, as the projection position of the visible light.

The projection position acquiring unit may be provided separately from the remote controller. The projection position acquiring unit may include a distance image sensor for imaging the visible light to acquire a distance image indicative of a three-dimensional optical path of the visible light. The projection position acquiring unit is configured to find the relative positional relationship of the projection position of the visible light with respect to the distance image sensor based on the distance image acquired by the distance image sensor and to calculate the three-dimensional coordinates of the projection position in an arrangement space of the lighting device based on the relative positional relationship thus found and the pre-acquired three-dimensional coordinates of the distance image sensor in the arrangement space of the lighting device, and the lighting device selecting unit is configured to acquire the three-dimensional coordinates of the projection position calculated by the projection position acquiring unit without going through the remote controller transmitting unit.

The lighting device selecting unit may be configured to select, as a control target, the lighting device existing within a selection area determined on the basis of the projection position of the visible light.

The remote controller may include an area changing operation unit for enlarging or reducing the selection area, the remote controller transmitting unit is configured to wirelessly transmit area changing information indicative of the content of the selection area changing operation performed by the area changing operation unit to the control device, and the control device receiving unit may be configured to receive the area changing information wirelessly transmitted from the remote controller transmitting unit, the lighting device selecting unit may be configured to select, as the control target, the lighting device existing within the changed selection area based on the area changing information received by the control device receiving unit.

When a locus of the projection position of the visible light forms a closed curve, the lighting device selecting unit may select, as a control target, the lighting device existing within a space surrounded by the closed curve when seen from the remote controller.

In accordance with the present invention, light properties are set through the use of the remote controller and the light emitted from the remote controller illuminates and points a control target lighting device, so that the control target lighting device is controlled pursuant to the light properties thus set. This makes it possible to realize an illumination system of simple operation and enhanced usability particularly for a plurality of control target lighting devices.

BRIEF DESCRIPTION OF THE DRAWINGS

The objects and features of the present invention will become apparent from the following description of embodiments, given in conjunction with the accompanying drawings, in which:

FIG. 2 is an electric block diagram of the illumination system;

DETAILED DESCRIPTION OF THE EMBODIMENTS

Figure 1:
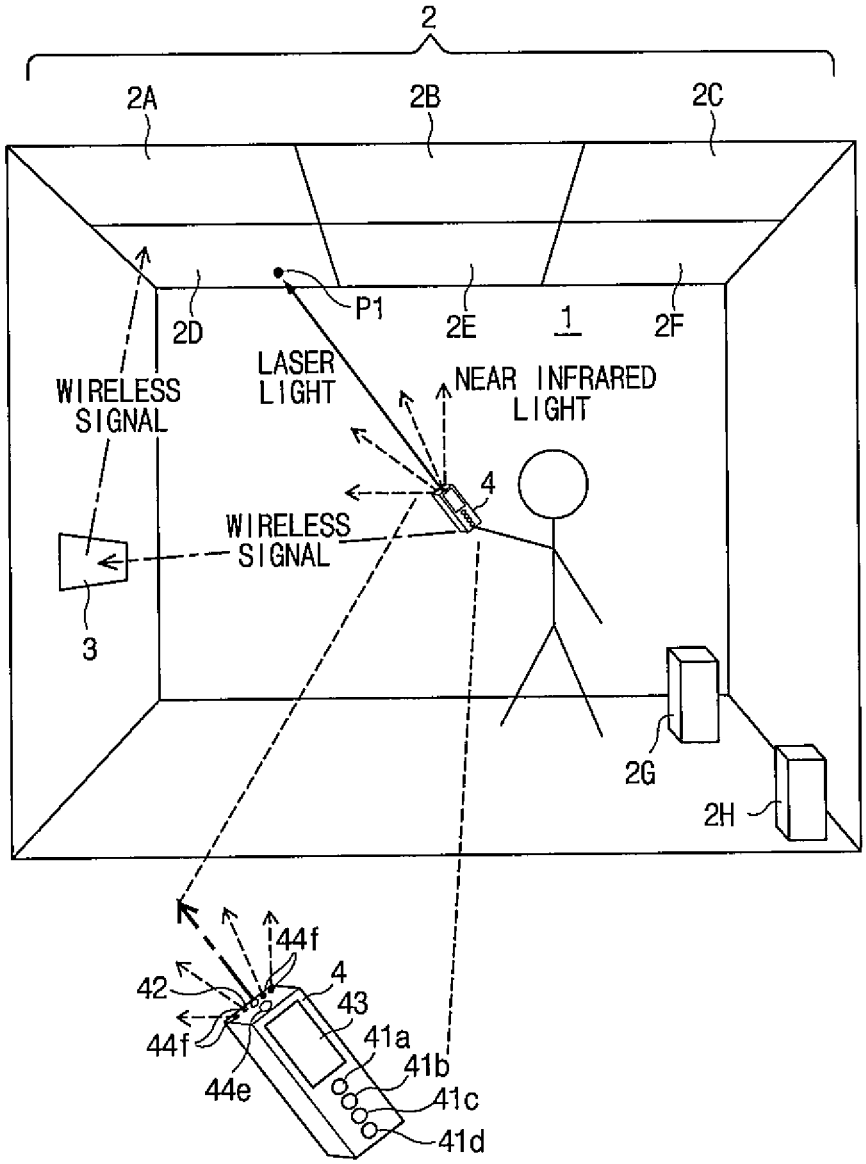
FIG. 1 is a one-point perspective projection view showing an illumination system in accordance with a first embodiment of the present invention.

An illumination system in accordance with a first embodiment of the present invention will now be described with reference to FIGS. 1 to 4D. FIG. 1 shows the configuration of the illumination system in accordance with the present embodiment. The illumination system 1 of the present embodiment includes a plurality of lighting devices 2A to 2H (hereinafter generally referred to as "lighting devices 2"), a control device 3 for controlling the lighting devices 2 and a remote controller 4 for remotely setting control content of the control device 3.

The illumination system 1 is preferably used as an illumination system for houses or other buildings. Control properties to be applied to the lighting devices 2 as control targets are set by the remote controller 4. If one of the lighting devices 2 is pointed as a control target by the laser light emitted from the remote controller 4, the control device 3 detects the laser light and controls the designated lighting device 2 pursuant to the control properties set by the remote controller 4. The control properties include a light color, a light amount (brightness) and color saturation. In FIG. 1, P1 is a projection position of the laser light.

The lighting devices 2A to 2F are of a fixed type secured on a ceiling and are arranged on the ceiling in a matrix pattern. The lighting devices 2G and 2H are of a movable type and are mounted on a floor surface. The respective lighting devices 2 may be either a fixed type fixed in installation places or a movable type in changeable installation places. Fixed-type lighting devices include a ceiling light, a base light, a spot light, a down-light, a pendant light, a cornice lighting device or a cove lighting device. Movable-type lighting devices include a wiring duct type spot light movable along a rail fixed on a ceiling or a lift type pendant light vertically movable along a rail fixed on a wall. The movable-type lighting devices further include a stand light, a lantern torch, a display or a digital signage. As a lighting device that can become a fixed type and a movable type, there is available a recessed lighting device in which a light source is installed within a furniture or a building component to reduce the sense of existence of the lighting device. In the recessed lighting device, a light projection opening is formed in an object within which the light source is installed and is covered with a transparent light guide plate. The number, shape and arrangement of the lighting devices 2 are not limited to the illustrated ones.

Depending on a shape and purpose, each of the lighting devices 2 is appropriately provided with an optical member or a reflection plate. For example, various kinds of lenses, prisms, louvers, filters or the like are used as the optical member. A filter suitable for the purpose is used among the filters having the function of light diffusion, light collection, light polarization, wavelength cut, wavelength conversion or the like. The optical member is made of a light-transmitting plastic, a glass or a coated metal plate. The reflection plate is used to reflect a light in a desired direction. The reflection plate is formed of an alumite reflection plate, an aluminum deposition reflection plate, a silver deposition reflection plate, a resin reflection plate, a cold mirror or the like. The reflection plate has a reflection surface formed of a mirror surface, a light diffusion surface and the like. If necessary, each of the lighting devices 2 may be provided with a liquid lens or a liquid crystal lens whose transmittance or directivity is changed depending on an input voltage.

The control device 3 is configured to make wired or wireless communications with the lighting devices 2 and to make wireless communications with the remote controller 4. The control device 3 may be an embedded type which is built-in a wall or the like. However, the control device 3 may not be of an embedded type.

The remote controller 4 includes setting switches 41*a* to 41*d* for use in setting the light properties and converting the on/off setting of laser light emission and an image sensor 41*e* (an imaging unit) for imaging a sample having the light properties to be set or an information code indicative of the light properties. The image sensor 41*e* can be formed of a CCD sensor or a CMOS sensor. The information code includes a barcode or a QR Code® (a two-dimensional barcode). The sample and the information code may be the ones displayed on a personal computer.

The remote controller 4 further includes a pointer 42 that emits a laser light (visible light) for illuminating and pointing the lighting device 2 to be controlled and a notification unit 43 for notifying a user of the set information. The remote controller 4 also includes a near-infrared LED (Light Emitting Diode) 44*f* that generates a near-infrared signal wave for detecting the position of the remote controller 4. The notification unit 43 is formed of a display, a speaker or the like.

FIG. 2 shows the electric configuration of the illumination system 1.

(Remote Controller 4)

The remote controller 4 includes a setting unit 41 (a light property setting unit) for setting the light properties of the lighting device 2 to be controlled, as well as the pointer 42 and the notification unit 43 stated above. The setting switches 41*a* to 41*d* and the image sensor 41*e* are included in the setting unit 41. The remote controller 4 further includes a projection position acquiring unit 44 for acquiring the projection position information indicative of the projection position P1 (see FIG. 1) of the laser light emitted from the pointer 42. The remote controller 4 further includes a transmitting unit 45 (a remote controller transmitting unit) and a control unit 46. The transmitting unit 45 wirelessly transmits the property information indicative of the light properties set by the setting unit 41 and the projection position information acquired by the projection position acquiring unit 44 to the control device 3. The control unit 46 controls the respective units of the remote controller 4.

The setting unit 41 includes an operation circuit 41*f* for analyzing an image taken by the image sensor 41*e* to obtain the light properties. The operation circuit 41*f* automatically sets the obtained light properties as the light properties of the lighting device 2 to be controlled. The operation circuit 41*f* can be formed of a microprocessor or the like.

The setting switch 41*a* is used to set parameters such as a color temperature, a light amount and color saturation, which are some kinds of light properties. The setting switch 41*a* is formed of a rotationally-operable volume type switch. The magnitude of a parameter such as a color temperature or the like can be adjusted depending on the rotating operation amount of the setting switch 41*a*. It is preferable that the color temperature be exponentially changed pursuant to the operation amount of the setting switch 41*a*. The setting switch 41*a* (as a setting adjustment unit) can, when rotationally operated, finely adjust the content of the light properties automatically set by the operation circuit 41*f*. The setting switch 41*a* transmits a command signal for the execution of various kinds of adjustment to the operation circuit 41*f*. The setting switch 41*a* may be configured so that it can be pushed down. In that case, the parameter to be set is changed each time the setting switch 41*a* is pushed by a user. The parameter to be set is notified from the notification unit 43.

The setting switch 41*b* is a switch used to switch the subject for setting the light properties. The setting switch 41*b* is formed of a volume type switch that can be rotated stepwise. When rotationally operated, the setting switch 41*b* outputs to the operation circuit 41*f* a signal for deciding which of the setting switch 41*a* and the image sensor 41*e* will be used to set the light properties. Moreover, the setting switch 41*b* outputs a signal for starting or stopping a fine adjustment mode in which the automatically set light properties are finely adjusted based on the rotational operation.

The setting switch 41*c* is a switch for fixing or cancelling various kinds of settings. The setting switch 41*c* is formed of a push button switch or the like. When pushed, the setting switch 41*c* transmits to the operation circuit 41*f* a command signal for fixing or cancelling various kinds of settings. The push button switch is preferably a capacitive type but may be a resistive type or an optical type. In case of a capacitive type push button switch, a switch element is covered with a resin sheet or the like. As the switch element is pushed by a finger, the capacitance of the switch element is changed. In response to the change in capacitance, the push button switch performs an on/off operation. The push button switch is not limited to the aforementioned type in which the capacitance is changed by the contact operation but may be a contactless operation type in which the capacitance is changed as a finger or the like comes close to the push button switch.

The setting switch 41*d* is formed of a push button switch. When pushed, the setting switch 41*d* outputs to the operation circuit 41*f* a command signal for causing the pointer 42 to emit a laser light and to generate a signal wave for detecting the position of the remote controller. If continuously pushed for a specified time, the setting switch 41*d* outputs to the operation circuit 41*f* a command signal for executing an acquiring process of the projection position information and a transmitting process of the projection position information and the property information. When a pushing operation is released (when a finger is detached from the button), the setting switch 41*d* transmits to the operation circuit 41*f* a command signal for stopping the emission of the laser light, the generation of the signal wave for detecting the position of the remote controller and the respective processes stated above.

The operation circuit 41*f* (as a setting adjustment unit) notifies a user of the automatically set light properties via the notification unit 43. If the setting switch 41*a* is operated by the user in response to the notification, the operation circuit 41*f* adjusts the content of the light properties pursuant to the operation. The operation circuit 41*f* also notifies the user of the adjusted content through the notification unit 43. The operation circuit 41*f* performs various kinds of processes in response to the command signals transmitted from the setting switches 41*a* to 41*d* when the setting switches 41*a* to 41*d* are operated.

The pointer 42 modulates the laser light with a modulating signal and outputs the laser light thus modulated. The subcarrier frequency of the laser light, i.e., the frequency of the modulating signal, is equal to, e.g., about 28.8 kHz and is set smaller than e.g., about 38 kHz, the frequency of the infrared light used in the communications between the control device 3 and the remote controller 4. The subcarrier frequency is preferably set in such a level that the laser light should not look like it is flickering. The communication speed of the modulating signal is preferably equal to, e.g., about 4.8 kbps. Four-value PPM (Pulse Position Modulation) is used as a modulation method.

The projection position acquiring unit 44 includes a remote controller position detecting circuit 44*a* (a remote controller position detecting unit) for detecting the position of the remote controller 4. The projection position acquiring unit 44 further includes a posture detecting circuit 44*b* for detecting the posture of the remote controller 4 and a direction detecting circuit 44*c* (a direction detecting unit) for detecting the emission direction of the laser light of the pointer 42 based on the posture detected by the posture detecting circuit 44*b*. The projection position acquiring unit 44 further includes a distance measuring circuit 44*d* (a distance measuring unit) and a calculation circuit 44*e*.

The distance measuring circuit 44*d* measures the distance from the remote controller 4 to the projection position P1 of the laser light by using the laser light emitted from the pointer 42 and reflected by a projection target object. The posture detecting circuit 44*b* detects the azimuth angle and the inclination angle (the elevation angle and the depression angle) of the remote controller 4 in order to find the three-dimensional posture, i.e., the three-dimensional direction angle, of the remote controller 4.

The calculation circuit 44*e* calculates the three-dimensional coordinates (hereinafter just referred to as "coordinates") of the position which is moved forward from the position of the remote controller 4 detected by the remote controller position detecting circuit 44*a* in the emission direction detected by the direction detecting circuit 44*c* by the distance measured by the distance measuring circuit 44*d*. The calculation circuit 44*e* recognizes the calculated coordinates as the coordinates of the projection position P1 of the laser light. The calculation circuit 44*e* can be formed of a microprocessor or the like.

The remote controller position detecting circuit 44*a* includes a plurality of near-infrared LEDs 44*f* for emitting near-infrared signal waves with high directivity in different directions and a distance image sensor 44*g* for capturing the signal wave emitted from the near-infrared LEDs 44*f* and reflected by a projection target object. The distance image sensor 44*g* includes a plurality of photodiodes which are arranged in a corresponding relationship with individual pixels in the image formation position of an optical system.

With respect to each of the pixels of the distance image sensor 44*g*, the remote controller position detecting circuit 44*a* measures the time period from the time when a signal wave is emitted by the near-infrared LEDs 44*f* to the time when the signal wave is reflected and returned to the distance image sensor 44*g* to measure the distances to the respective portions of a projection target object. From the results of measurement, the remote controller position detecting circuit 44*a* acquires a distance image indicative of the three-dimensional information of the shape of the projection target object.

The distance image sensor 44*g* is formed of, e.g., a CMOS sensor, a CCD sensor or the like, and is arranged so that it can be exposed from the housing of the remote controller 4. The distance image sensor 44*g* includes a substrate and three or more photoelectric conversion devices mounted on the substrate in an array pattern. Each of the photoelectric conversion devices receives a near-infrared signal wave and converts the received signal wave into an electric signal through a photoelectric conversion process. The electric signal is transmitted to the calculation circuit 44*e*. The distance image sensor 44*g* may serve as the image sensor 41*e*.

The remote controller position detecting circuit 44*a* includes a memory that stores in advance the coordinates (hereinafter referred to as "space coordinates") of a space formation member, e.g., a ceiling, a wall or a floor, forming a space (hereinafter referred to as "lighting device arrangement space") in which the respective lighting devices are arranged, and the relationship between the space coordinates and the azimuth angle. Using the principle of trilateration, the remote controller position detecting circuit 44*a* obtains the relative position of the remote controller 4 with respect to the portion of the space formation member reflected in the distance image. Then, the remote controller position detecting circuit 44*a* obtains the space coordinates of the portion of the space formation member reflected in the distance image, on the basis of the relationship between the space coordinates and the azimuth angle previously stored in the memory, and the azimuth angle detected by the posture detecting circuit 44*b*. The remote controller position detecting circuit 44*a* specifies the position coordinates of the remote controller 4 by using the space coordinates thus found and the information on the relative position.

The posture detecting circuit 44*b* includes a terrestrial magnetism sensor as a sensor for detecting the azimuth angle. The terrestrial magnetism sensor detects the azimuth angle on a specified time basis, e.g., every 10 milliseconds. The posture detecting circuit 44*b* further includes an acceleration sensor as a sensor for detecting the inclination angle. The acceleration sensor detects the inclination angle on a specified time basis, e.g., every 10 milliseconds. The posture detecting circuit 44*b* further includes a calculation circuit for calculating the posture of the remote controller 4 by using the detection signals generated by the terrestrial magnetism sensor and the acceleration sensor. The calculation circuit detects the inclination angle by adding up the values detected by the acceleration sensor.

A one-axis sensor, a two-axes sensor or a three-axes sensor having X, Y and Z axes is used as the acceleration sensor. The calculation circuit digitizes the detection signals indicative of the azimuth angle and the inclination angle. The detection signals are subjected to specified digital signal processing by applying an averaging algorithm. The digital signal processing is performed to smooth out the fluctuation of the detection values of the azimuth angle and the inclination angle, thereby reducing a change in the detection values caused by noise disturbance. The digital signal processing makes it possible to enhance the detection accuracy. Moreover, the digital signal processing can provide a countermeasure against the hand shake possibly generated when operating the setting switches 41*a* to 41*d* and can reduce a change in the detection values caused by the hand shake.

The distance measuring circuit 44*d* includes a light receiving sensor for receiving the laser light emitted from the pointer 42 and reflected by the projection target object. The distance measuring circuit 44*d* measures the distance from the remote controller 4 to the projection position P1 of the laser light by multiplying the time period from the time when the laser light is emitted from the pointer 42 to the time when the laser light is reflected by the projection target object and received by the light receiving sensor and the speed of the laser light previously stored in the memory. The distance measuring circuit 44*d* may have a memory of pre-storing the light intensity of the laser light emitted from the pointer 42. In that case, the distance measuring circuit 44*d* divides, by the light intensity attenuation factor per unit distance, the difference between the light intensity mentioned above and the light intensity of the laser light received by the light receiving sensor, thereby measuring the distance from the remote controller 4 to the projection position P1 of the laser light.

If the setting unit 41 is not operated for a specified time period, the calculation circuit 44*e* is shifted, after the lapse of the specified time period, to a standby mode in which only the necessary minimum processing is performed. This reduces the electric power consumed by the calculation circuit 44*e*. If the setting unit 41 is operated in the standby mode, the calculation circuit 44*e* comes back to a normal operation mode.

The communications made between the transmitting unit and the control device 3 may be one of visible light communications, infrared communications, specific power-saving wireless communications using a radio frequency, near field communications and wireless LAN communications. The transmitting unit 45 is formed of a transmission circuit that can make one of the aforementioned communications. Specific examples of the near field communication include Bluetooth®-based communication. The transmitting unit 45 is configured to collectively transmit remote controller signals, namely a start code, various kinds of information on a transmission target, an error detection code and an end code in the named order. In case where the illumination system 1 is provided with a plurality of remote controllers 4, it is preferred that remote controller IDs specific to the respective remote controllers 4 are given to the remote controller signals. The transmission speed of the remote controller signals is, e.g., equal to 19.2 kbps. The transmission interval of the remote controller signals is equal to, e.g., 100 milliseconds. It is preferred that the transmitting unit 45 can control the directivity depending on the environment within the arrangement space of the lighting devices 2.

Upon operating the setting switch 41*d*, the control unit 46 switches the emission and non-emission of the laser light from the pointer 42 or the emission and non-emission of the signal wave from the remote controller position detecting circuit 44*a*. Moreover, the control unit 46 controls the notification to the outside performed by the notification unit 43, the communications with the control device 3 performed by the transmitting unit 45 and the communications made between the respective units of the remote controller 4. The control unit 46 can be formed of a control circuit including a microprocessor.

While not shown in the drawings, the remote controller 4 includes a power supply unit for supplying electric power to the respective units of the remote controller 4. The power supply unit may be formed of any one of a primary battery and a secondary battery. In case of using the secondary battery, a coil is provided with the power supply unit. By the electromagnetic induction between the coil of the power supply unit and the coil of a battery charger, the electric power is fed to the secondary battery in a contactless manner without going through any connection terminal, whereby the secondary battery can receive the electric power. In that case, the control device 3 may be provided with a battery charger. In addition, the control device 3 may be provided with a mechanism to which the remote controller 4 is detachably attached. In a state that the remote controller 4 is attached to the mechanism, the battery charger may charge the secondary battery.

(Control Device 3)

The control device 3 includes a receiving unit 31 (a control device receiving unit) for receiving the property information and the projection position information transmitted from the transmitting unit 45. The control device 3 further includes a control unit 32 (a lighting device selecting unit) for selecting a control target lighting device 2 based on the projection position information received by the receiving unit 31 and the information on the positions of the lighting devices 2 acquired in advance. The control device 3 further includes a transmitting unit 33 (a control device transmitting unit) for transmitting the property information received by the receiving unit 31 to the control target lighting device 2 selected by the control unit 32.

The receiving unit 31 is formed of a receiving circuit that can make communications with the transmitting unit 45. The control unit 32 is formed of a control circuit that includes a microprocessor for executing various kinds of operations and a memory for storing a variety of information referred to in the operations. The space coordinates stated above, the lighting device IDs for specifying the respective lighting devices 2, the position coordinates of the respective lighting devices 2 and the section data indicative of the sections divided on the basis of the positions of the respective lighting devices 2 are stored in the memory in advance. The space coordinates, the position coordinates of the respective lighting devices 2 and the section data can be obtained from the CAD data or the like on a building drawing and a lighting device arrangement drawing. The section data are set with respect to each of the lighting devices 2. The sections indicated by the section data are, e.g., three-dimensional sections of a rectangular parallelepiped shape, a rectangular hexahedron shape or a spherical shape which extend from the positions of the respective lighting devices 2. The sections may overlap with one another between the lighting devices 2. The section data can be arbitrarily set and changed by a user depending on the shape and size of the lighting device arrangement space or the position and shape of each of the lighting devices 2.

By referring to the memory, the control unit 32 determines which of the sections contains the projection position coordinates of the laser light indicated in the projection position information. If a specified section contains the projection position coordinates, the control unit 32 selects the lighting device 2 forming a reference point of the specified section as a control target.

The transmitting unit 33 is formed of a transmitting circuit for communicating with the respective lighting devices 2 in a polling method. By virtue of the polling method, the transmitting unit 33 establishes communications with the lighting device 2 set as a control target by the control unit 32, by transmitting and receiving the lighting device ID of the lighting device 2 to and from the lighting device 2. Thereafter, the transmitting unit 33 collectively transmits a start code, various kinds of information on a transmission target, an error detection code and an end code to the control target lighting device 2 in the named order. The transmission speed of the signals thus transmitted is, e.g., equal to 19.2 kbps. The transmission interval of the signals is equal to, e.g., 100 milliseconds.

The communications between the transmitting unit 33 and the respective lighting devices 2 may preferably be visible light communications, infrared communications, specific power-saving wireless communications using a radio frequency, near field communications, wireless LAN communications and so forth. The communication between the transmitting unit 33 and the respective lighting devices 2 is wireless communications and therefore is more suitable for movable lighting devices 2.

While not shown in the drawings, the control device 3 includes a power supply unit for converting an AC voltage supplied from a commercial power supply to a DC voltage. The power supply unit supplies the converted DC voltage to the respective units in the control device 3.

(Lighting Devices 2)

The respective lighting devices 2 have a common configuration. The configuration of the lighting device 2A is representatively shown in FIG. 2. The lighting device 2A includes a light source unit 21, a drive unit 22 for turning on a light source and a receiving unit 23 (a lighting device receiving unit) for receiving the property information transmitted from the transmitting unit 33. The lighting device 2A further includes a control unit 24 (a lighting device control unit) for PWM-controlling the light source unit 21 through the use of the drive unit 22 based on the property information received by the receiving unit 23.

The light source unit 21 is formed of a red LED 21*r*, a green LED 21*g* and a blue LED 21*b* (hereinafter generally referred to as "LEDs 21*r*, 21*g* and 21*b*"). If the light quantity ratio of the LEDs 21*r*, 21*g* and 21*b* is adjusted, it is possible to change the color of the composite light of the LEDs 21*r*, 21*g* and 21*b*. If the light quantity is adjusted while maintaining the light quantity ratio of the LEDs 21*r*, 21*g* and 21*b*, it is possible to change the quantity of the composite light while keeping the color of the composite light unchanged. If the light quantities of the LEDs 21*r*, 21*g* and 21*b* are adjusted so that the chromaticity of the composite light can vary substantially in conformity with a black body locus, it is possible to designate the composite light color with a color temperature. The light quantities of the LEDs 21*r*, 21*g* and 21*b* can be adjusted by increasing or decreasing the amount of electric current supplied to the LEDs 21*r*, 21*g* and 21*b*. The number of the LEDs 21*r*, 21*g* and 21*b* can be appropriately decided depending on the size thereof.

Together with the drive unit 22, the receiving unit 23 and the control unit 24, the light source unit 21 may be accommodated within a housing of a device body. Or, independently of the drive unit 22, the receiving unit 23 and the control unit 24, the light source unit 21 may be accommodated within a housing differing from the housing of the device body and may be formed into a module. The housing may be formed of a shading member having a light projection opening in a portion thereof and may be provided with a light-transmitting panel for closing the light projection opening. Alternatively, a substantially entire portion of the housing may be formed of a light-transmitting panel. The housing is preferably made of a non-brittle material, e.g., a plastic, a composite material obtained by mixing a reinforcing filler material such as glass fibers with a plastic, metal such as aluminum alloy, iron, magnesium alloy or the like, or wood.

The drive unit 22 is formed of drive circuits 22*r*, 22*g* and 22*b* corresponding to the LEDs 21*r*, 21*g* and 21*b*. The drive circuits 22*r*, 22*g* and 22*b* are used to drive the LEDs 21*r*, 21*g* and 21*b* corresponding thereto. The drive unit 22 has a configuration capable of independently driving the LEDs 21*r*, 21*g* and 21*b* with the drive circuits 22*r*, 22*g* and 22*b*.

The drive circuits 22*r*, 22*g* and 22*b* have a common circuit configuration. Responsive to the PWM signals inputted from the control unit 24, the drive circuits 22*r*, 22*g* and 22*b* adjusts the electric currents supplied to the LEDs 21*r*, 21*g* and 21*b* corresponding thereto. Each of the drive circuits 22*r*, 22*g* and 22*b* includes a switching element for, in response to the PWM signals, permitting or preventing the supply of electric power from the below-mentioned power supply unit to the LEDs 21*r*, 21*g* and 21*b* and a resistance element for limiting the electric current supplied to the LEDs 21*r*, 21*g* and 21*b* during the on time of the switching element. The switching element has a source connected to a high-potential-side output terminal of the power supply unit through the resistance element, a drain connected to a low-potential-side output terminal (the ground) of the power supply unit and a gate to which the PWM signals are inputted. The switching element is preferably a field effect transistor capable of coping with a switching operation performed at a high frequency. The receiving unit 23 is formed of a receiving circuit that can communicate with the transmitting unit 33 of the control device 3.

The control unit 24 inputs a PWM signal, i.e., a square wave signal having a variable on-duty ratio and a constant period, to the drive circuits 22*r*, 22*g* and 22*b*. The period of the PWM signal is common between the drive circuits 22*r*, 22*g* and 22*b*. Based on the light properties received by the receiving unit 23, the control unit 24 independently controls the on-duty ratio of the PWM signal between the drive circuits 22*r*, 22*g* and 22*b*. By virtue of this control, the amounts of electric power supplied to the LEDs 21*r*, 21*g* and 21*b* are adjusted. Thus, the light quantities of the LEDs 21*r*, 21*g* and 21*b* are adjusted and the light properties of the composite light of the LEDs 21*r*, 21*g* and 21*b* are controlled.

The control unit 24 is formed of a control circuit that includes a microprocessor for executing various kinds of operations and a memory for storing a variety of information referred to in the operations. The memory stores a conversion table that tabulates: the light properties such as the light color, the light quantity and the color saturation; the chromaticity coordinates corresponding to the light color, the light quantity and the color saturation; and the on-duty ratios of PWM signals corresponding to the chromaticity coordinates. The microprocessor selects the on-duty ratio corresponding to the received light properties by referring to the conversion table and controls the actual on-duty ratio of the PWM signal so as to conform to the selected on-duty ratio. In this control, it is preferable that the light properties be smoothly changed over a specified time period in order to prevent a user from feeling unpleasant due to a sudden change of the light properties. It is preferable that the specified time period be arbitrarily set by a user through the use of an operating device (not shown) provided in the control device 3.

While not shown in the drawings, the lighting device 2A includes a power supply unit for converting an AC voltage supplied from a commercial power supply to a DC voltage. The power supply unit supplies the converted DC voltage to the respective units of the lighting device 2A. The power supply unit is suitable for a fixed lighting device 2A that is kept stationary. The power supply unit may be formed of a primary battery or a secondary battery. This configuration is suitable for a movable lighting device 2A. It is preferred that the primary battery or the secondary battery have an appropriate capacity depending on the power amount consumed by the lighting device 2A.

In case of using the secondary battery, a coil is provided with the power supply unit. By the electromagnetic induction between the coil of the power supply unit and the coil of a battery charger, the electric power is fed to the secondary battery in a contactless manner without going through any connection terminal, whereby the secondary battery can receive the electric power. In that case, the secondary battery can be charged by merely causing the battery charger to come close to the lighting device 2A. This makes it easy to perform a charging operation.

Figure 3:
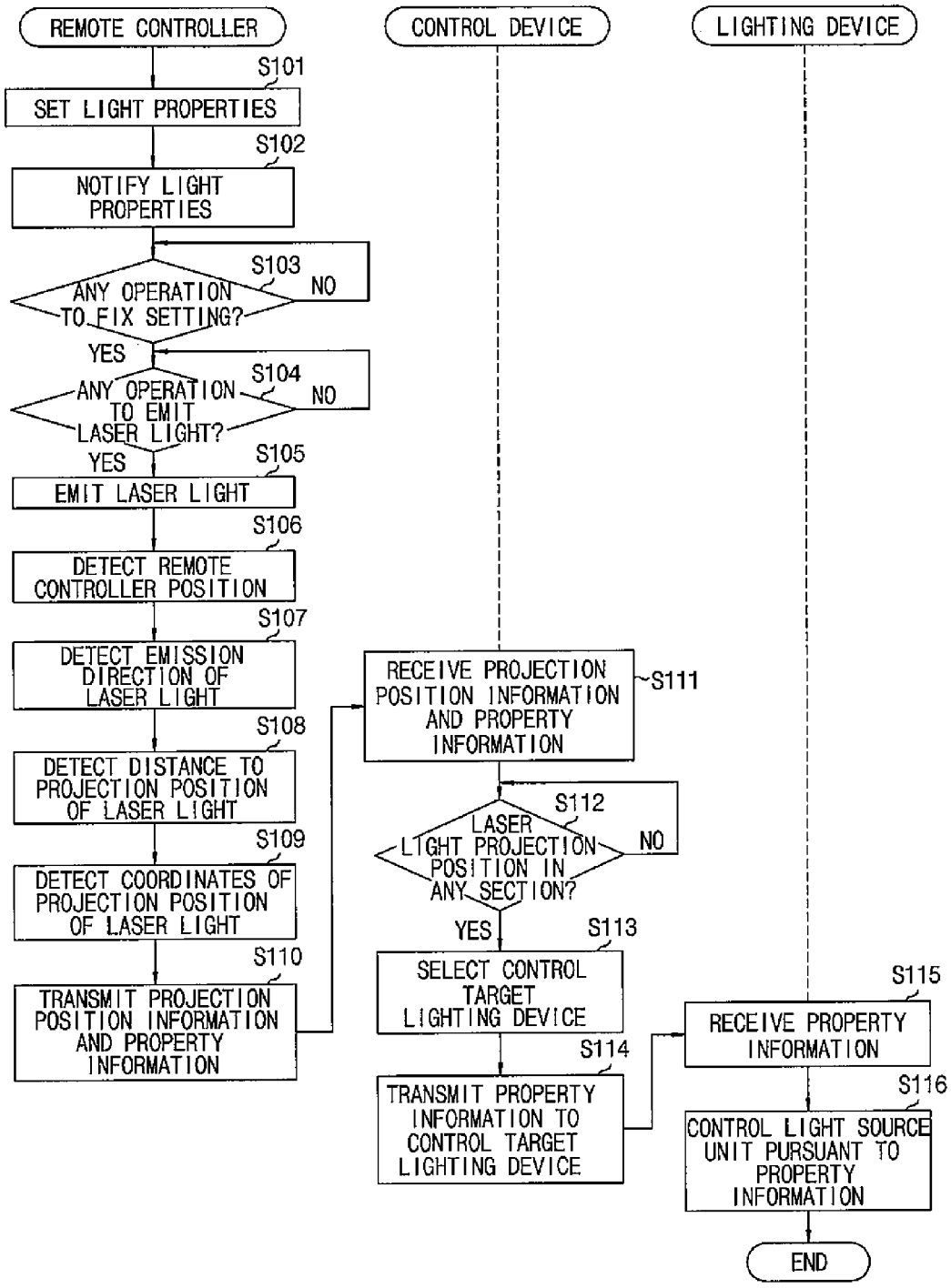
FIG. 3 is a flowchart illustrating an operational sequence of the illumination system.

Next, a control procedure of the respective lighting devices 2 of the illumination system 1 will be described with reference to FIG. 3 as well as FIGS. 1 and 2. FIG. 3 illustrates an operational sequence of the illumination system 1. Target light properties of the control target lighting device 2 are set by the setting unit 41 of the remote controller 4 (S101). At that time, the notification unit 43 notifies a user of the acquired light properties (S102). At this moment, the setting switch 41*b* is operated to set the remote controller 4 in a fine adjustment mode. When the setting switch 41*a* is rotationally operated, the operation circuit 41*f* adjusts the light properties depending on the rotational operation amount of the setting switch 41*a*. Thereafter, if the setting switch 41*c* is operated to fix the setting (if Yes in S103) and if the setting switch 41*d* is operated to cause laser light emission (if Yes in S104), the pointer 42 emits a laser light (S105).

Then, the remote controller position detecting circuit 44*a* detects the position of the remote controller 4 (S106). The direction detecting circuit 44*c* detects the emission direction of the laser light emitted from the pointer 42 (S107). The distance measuring circuit 44*d* measures the distance from the remote controller 4 to the projection position P1 of the laser light (S108). The calculation circuit 44*e* recognizes the coordinates of the position which is obtained by moving the position of the remote controller detected in step S106 along the emission direction detected in step S107 by the distance measured in step S108, as the coordinates of the projection position P1 of the laser light (S109). The transmitting unit 45 transmits the projection position information indicative of the coordinates of the projection position P1 obtained in step S109 and the property information indicative of the light properties fixed in step S103 to the control device 3 (S110).

The receiving unit 31 of the control device 3 receives the property information and the projection position information transmitted from the transmitting unit 45 (S111). Based on the projection position information received in step S111, the control unit 32 determines a section where the projection position P1 of the laser light exists. If it is determined that the projection position coordinates exist in any one section (if Yes in S112), the lighting device 2 set as a reference point of the section containing the projection position coordinates is selected as a control target (S113). If the projection position P1 is not included in any of the stored sections, it is determined that it is impossible to select a control target. The transmitting unit 33 transmits the property information to the lighting device 2 set as the control target (S114).

The receiving unit 23 of the control target lighting device 2 receives the property information transmitted from the transmitting unit 33 (S115). Based on the property information received by the receiving unit 23, the control unit 24 controls the light source unit 21 (S116).

Next, a use example of the illumination system 1 will be described with reference to FIGS. 4A to 4D as well as FIG. 2. FIGS. 4A to 4D show a use example of the illumination system 1 in a chronological order. In this regard, it is assumed that there exists a panel having a sample for imaging the color temperature of the light. The sample is formed of a color or a diagram for imaging, e.g., a flower (rose), a foodstuff (meat) or a time (early morning or evening). Together with the color and the diagram or as an alternative of the color and the diagram, an information code such as a barcode or the like may be attached to the panel. The sample or the information code on the panel is imaged by the image sensor 41*e* of the remote controller 4, thereby setting target light properties.

Figure 4A:
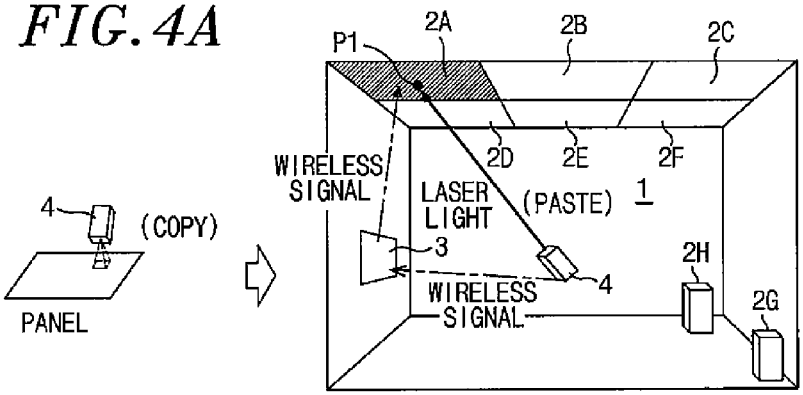
FIGS. 4A to 4D are one-point perspective projection views showing a use example of the illumination system in a chronological order.
Figure 4B:
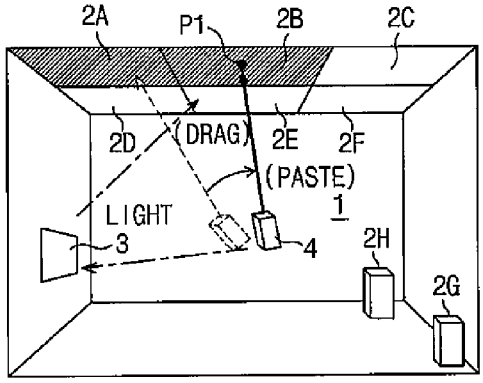
Figure 4C:
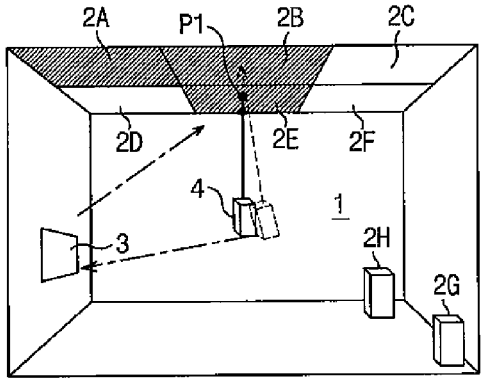
Figure 4D:
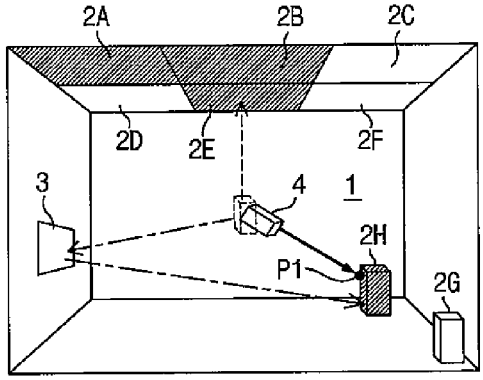

If the lighting device 2A as a control target is pointed by the laser light emitted from the remote controller 4, the lighting device 2A is turned on to reflect the target light properties (see FIG. 4A). In other words, a user can intuitively turn the lighting device 2A on pursuant to the set light properties by copying the light properties of the sample on the panel with the remote controller 4 and pasting the copied light properties on the control target lighting device 2A. When the lighting device 2B is pointed by the remote controller 4, i.e., when a so-called drag operation is performed, the same light properties as those of the lighting device 2A are pasted on the lighting device 2B, whereby the lighting device 2B is also turned on with the same light properties as those of the lighting device 2A (see FIG. 4B). Other lighting devices 2 can be turned on in the same manner (see FIGS. 4C and 4D).

In the embodiment described above, when the user sets the light properties by using the remote controller 4 and the control target lighting device 2 is pointed by the laser light emitted from the remote controller 4, the control target lighting device 2 is controlled pursuant to the set light properties. For example, the lighting devices 2 can be turned on by intuitive operations such as copying, pasting and dragging. Accordingly, it is possible to realize an easy-to-operate illumination system with high usability, particularly when there is a plurality of control target lighting devices 2 and when the control target lighting devices 2 are positioned away from a user.

The control target lighting device 2 can be selected with the laser light emitted from the remote controller 4, while seeing and confirming the control target lighting device 2. This makes it possible to intuitively grasp the lighting device 2 selected and to prevent a mistake in selecting the lighting device 2.

By merely imaging the sample having a light property sought to be reproduced by a user or the information code indicative of such a light property through the use of the image sensor 41*e*, it is possible to set the light property as a light property of the control target lighting device 2. Accordingly, as compared with a case where the chromaticity, the light quantity or the color saturation included in the light property are manually inputted, it is possible to reliably reproduce the light property sought to be reproduced by a user.

It is cumbersome to set the chromaticity, the light quantity and the color saturation one by one. Therefore, in the present embodiment, by merely imaging the sample having the chromaticity, the light quantity and the color saturation (i.e., light properties) as desired or the information code indicative of the light properties through the use of the image sensor 41*e*, it is possible to simultaneously set the light properties. This makes it possible to reduce the time required in setting the light properties.

The light properties of a plurality of lighting devices 2 can be set one after another by pasting, which makes it possible to reproduce so-called moving light. By merely adjusting the moving speed of the remote controller 4, it is possible to change the speed of the moving light and to perform the operation of changing the speed of the moving light with ease.

Next, certain modified examples of the foregoing embodiment will be described with reference to the drawings. In the respective modified examples, the components identical with those of the foregoing embodiment will be designated by like reference symbols. No description will be made on the same configurations as those of the foregoing embodiment.

First Modified Example

Figure 5:
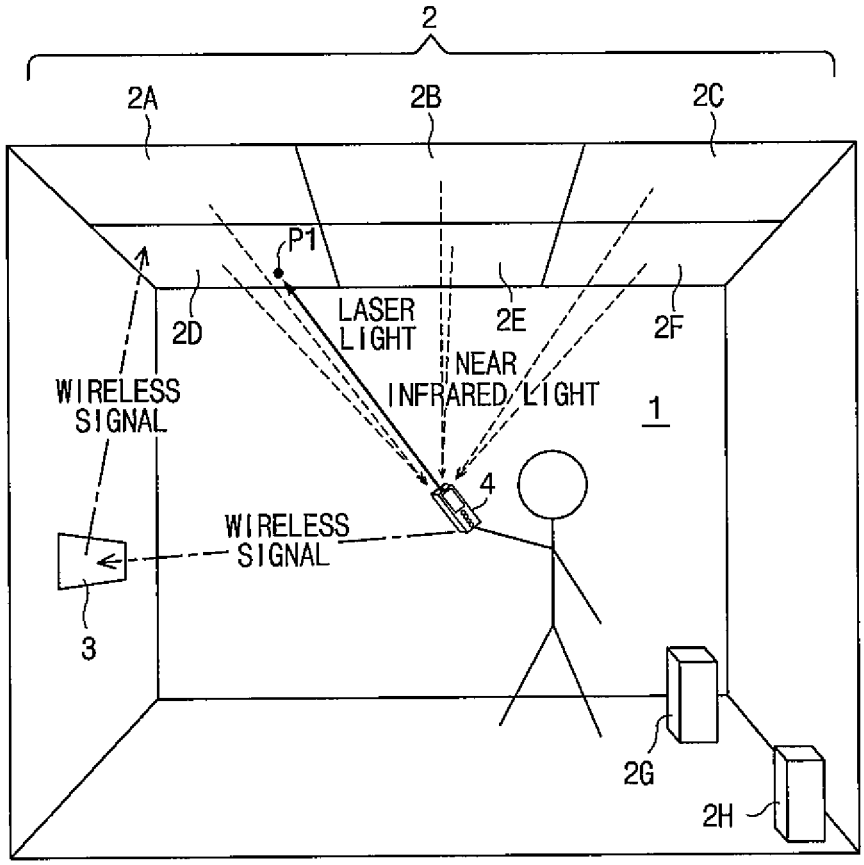
FIG. 5 is a one-point perspective projection view showing an illumination system in accordance with a first modified example of the first embodiment.

FIG. 5 shows the configuration of an illumination system 1 in accordance with a first modified example. In the present modified example, each of the lighting devices 2 wirelessly transmits current property information indicative of the current properties of the lighting devices 2 to the remote controller 4 through the use of near infrared light. The remote controller 4 is configured to set the current property information as a light property of another lighting device 2.

Figure 6:
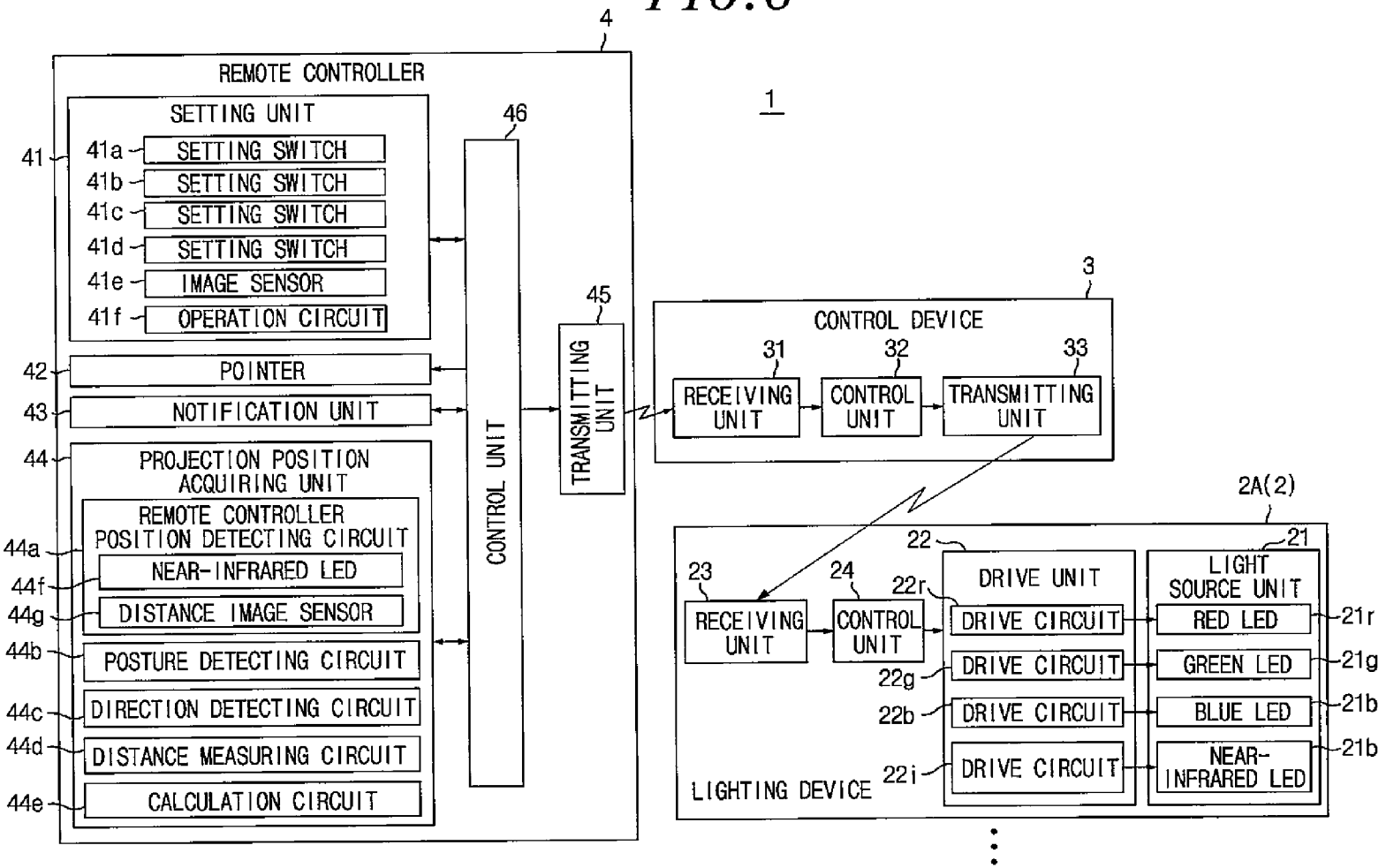
FIG. 6 is an electric block diagram of the illumination system shown in FIG. 5.

FIG. 6 shows the electric configuration of the illumination system 1 in accordance with the present modified example. Each of the lighting devices 2 further includes a near-infrared LED 21*i* (a lighting device transmitting unit) for emitting near infrared light modulated with the current property information and a drive circuit 22*i* for driving the near-infrared LED 21*i*. The drive circuit 22*i* has the same configuration as those of the drive circuits 22*r*, 22*g* and 22*b*.

The control unit 24 generates a modulating signal containing the current property information and transmits the modulating signal to the drive circuit 22*i*, thereby driving the drive circuit 22*i* with the modulating signal. Then, the near-infrared LED 21*i* is caused to emit infrared light modulated with the modulating signal. The control unit 24 is configured to collectively transmit, as the modulating signal, a start code, various kinds of information on a transmission target, an error detection code and an end code in the named order. The control unit 24 applies a lighting device ID corresponding to each of the lighting devices 2 to the modulating signal. The frequency of the modulating signal, i.e., the subcarrier frequency, is equal to, e.g., about 28.8 kHz and is set smaller than e.g., about 38 kHz, the frequency of the infrared light used in the communications between the control device 3 and the remote controller 4. The subcarrier frequency is preferably set in such a level that the laser light should not look like it is flickering. The communication speed of the modulating signal is preferably equal to, e.g., about 4.8 kbps. Four-value PPM (Pulse Position Modulation) is used as a modulation method.

In the remote controller 4, the distance image sensor 44*g* (the remote controller receiving unit) serves as a receiving unit for receiving the current property information wirelessly transmitted from the near-infrared LED 21*i*. The operation circuit 41*f* sets the light property indicated by the current property information received by the distance image sensor 44*g* as a light property of a control target lighting device 2 differing from the source lighting device. The operation circuit 41*f* discriminates the source lighting device by relying on the lighting device ID received together with the current property information.

In case where the distance image sensor 44*g* receives the current property information from a plurality of lighting devices 2, the setting switch 41*b* is configured to interchange a valid information selection mode, in which valid current property information is selected from the received current property information, with other modes. In the valid information selection mode, i.e., in the lighting device selection mode, the setting switch 41*a* is configured to select one of the lighting devices 2 whose current property information is to be made valid. When the distance image sensor 44*g* receives the current property information from a plurality of lighting devices 2, the notification unit 43 notifies the information indicative of the lighting devices 2 and also notifies the lighting device 2 whose current property information is made valid by the setting switch 41*a*.

Figure 7:
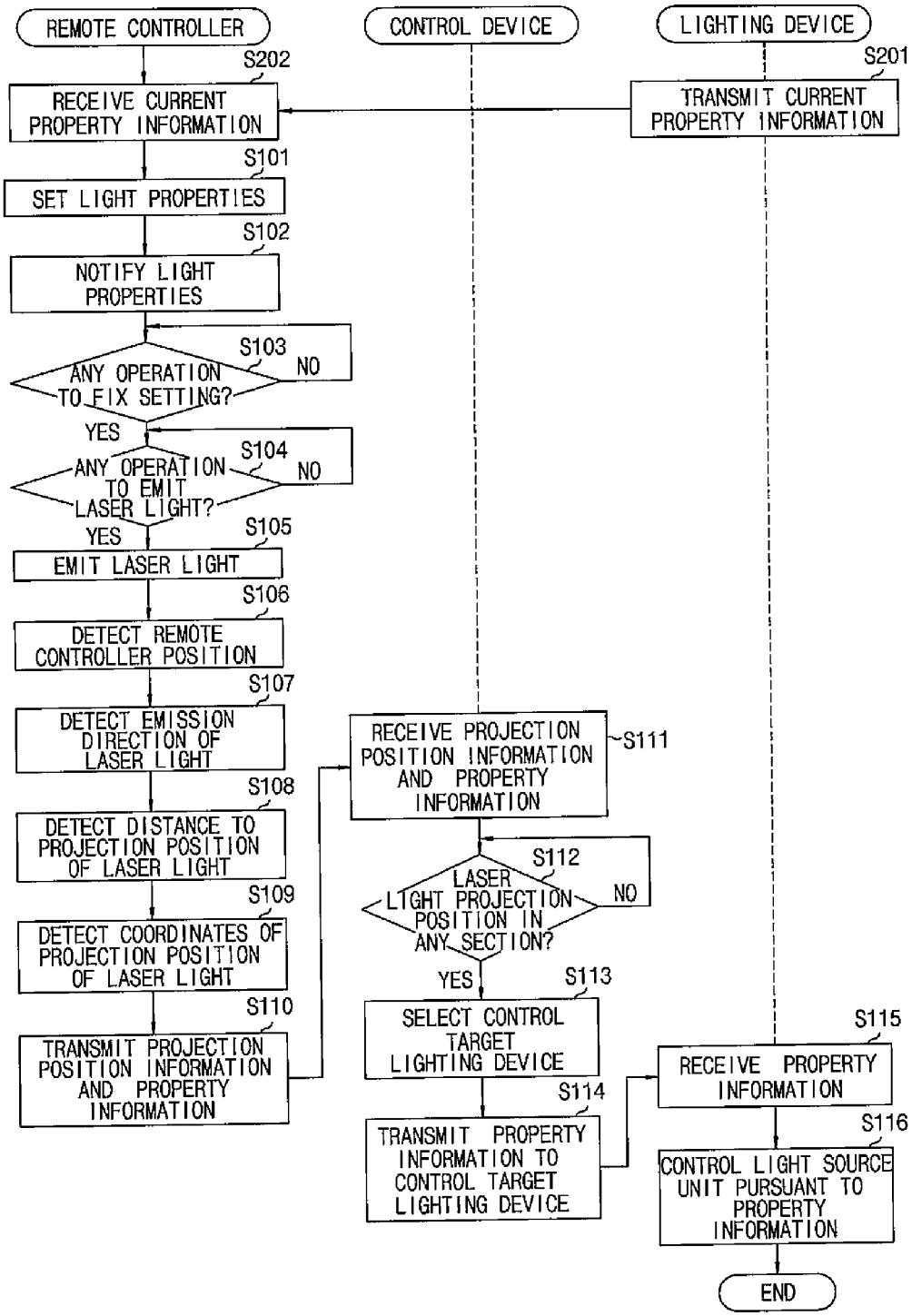
FIG. 7 is a flowchart illustrating an operational sequence of the illumination system shown in FIG. 5.
Figure 8A:
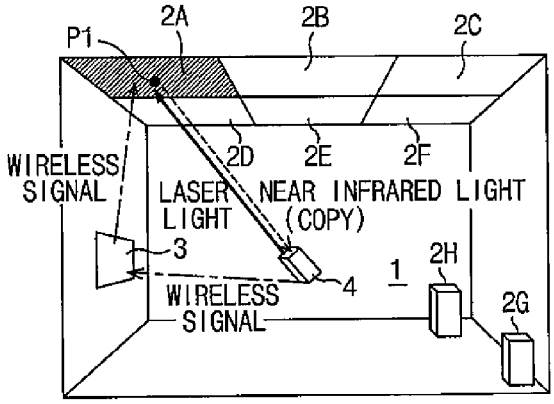
FIGS. 8A to 8D are one-point perspective projection views showing a use example of the illumination system shown in FIG. 5 in a chronological order.
Figure 8B:
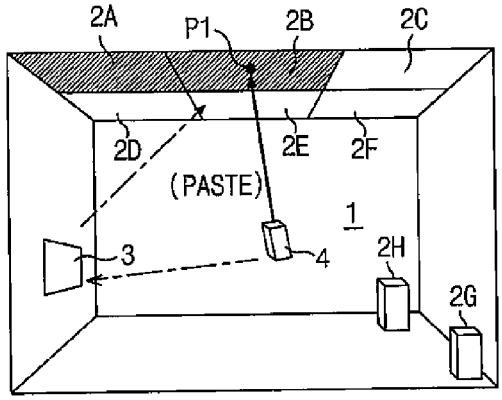
Figure 8C:
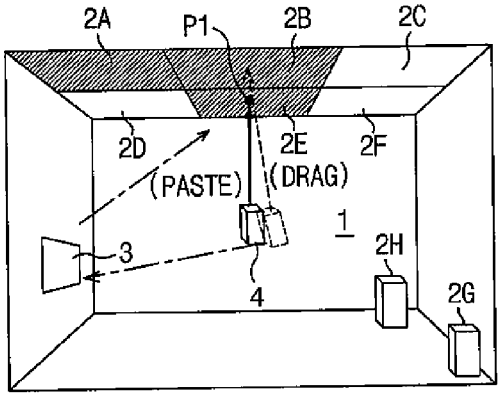
Figure 8D:
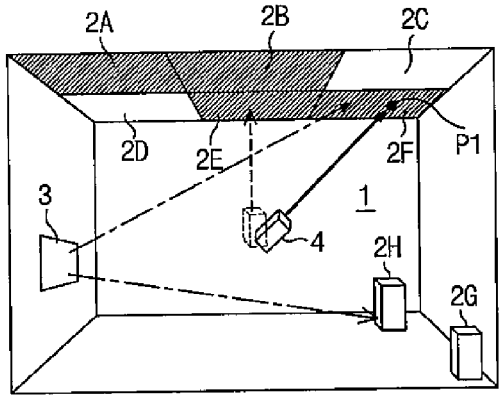

FIG. 7 shows a sequence of the illumination system 1 in accordance with the present modified example. In the sequence of the present modified example, as compared with the first embodiment (see FIG. 3), steps S201 and S202 are added before step S101. In step S201, the current property information is transmitted from the near-infrared LED 21*i* of each of the lighting devices 2 to the remote controller 4. In step S202, the current property information is received by the distance image sensor 44*g* of the remote controller 4. Also performed is the valid information selection mode in which the setting switch 41*a* selects one of the current property information of the lighting devices to be made valid.

FIGS. 8A to 8D show a use example of the illumination system 1 in accordance with the present modified example. In the present modified example, as compared with the foregoing embodiment (see FIG. 4), it is not necessary for the image sensor 41*e* to image the sample or the information code in order to set the light property information. It is only necessary to bring the remote controller 4 into the coverage of the near infrared light coming from the lighting devices 2.

In the present modified example, it is possible to obtain the same effect as available in the foregoing embodiment (This holds true in the respective modified examples to be described below). In order to operate some of the lighting devices 2, the sample or the information code is imaged by the image sensor 41*e* to set the light properties. Then, the light properties are finely adjusted. In the present modified example, even if the setting content is erased due to the battery replacement or other causes, the identical light properties can be set in another lighting device 2 by using the current property information obtained from the lighting device 2 for which the light properties have already been set. For that reason, the setting and the fine adjustment using the sample need not be performed twice in order to execute the same setting. This makes it possible to reduce the time and effort required in performing the setting operation.

Second Modified Example

Figure 9:
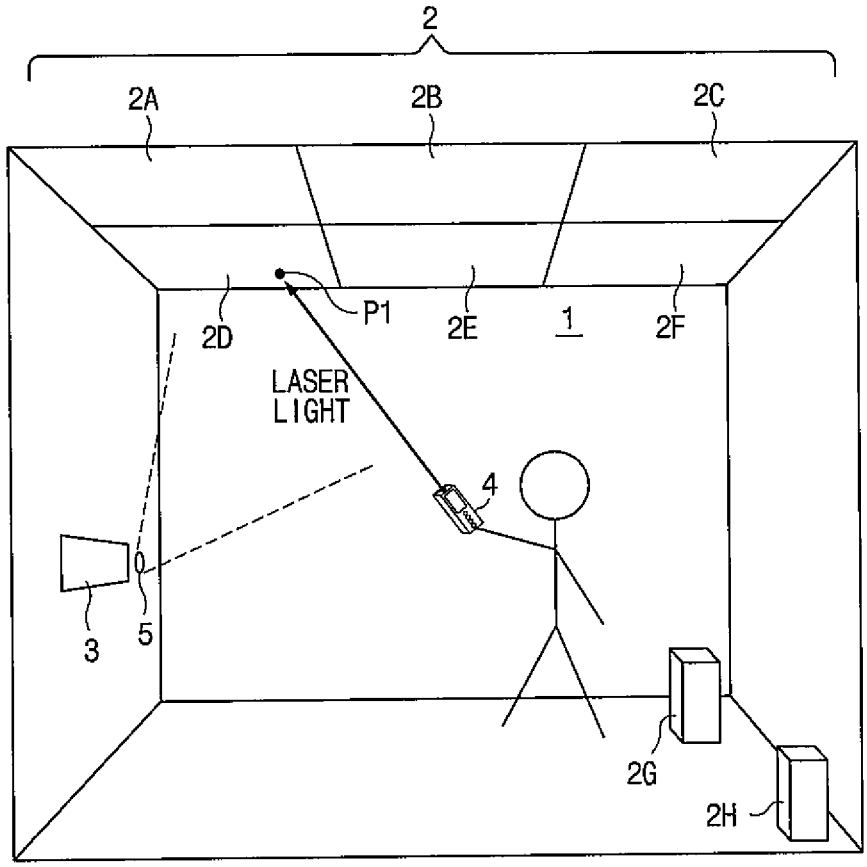
FIG. 9 is a one-point perspective projection view showing an illumination system in accordance with a second modified example of the first embodiment.

FIG. 9 shows the configuration of an illumination system 1 in accordance with a second modified example. The illumination system 1 of the present modified example includes, as an alternative of the projection position acquiring unit 44, a projection position acquiring device 5 (a projection position acquiring unit) provided on a wall separated from the remote controller 4. The projection position acquiring device 5 is used to acquire the projection position information indicative of the projection position P1 of the laser light emitted from the pointer 42. The installation place of the projection position acquiring device 5 is not limited to the wall but may be a ceiling or the like.

Figure 10:
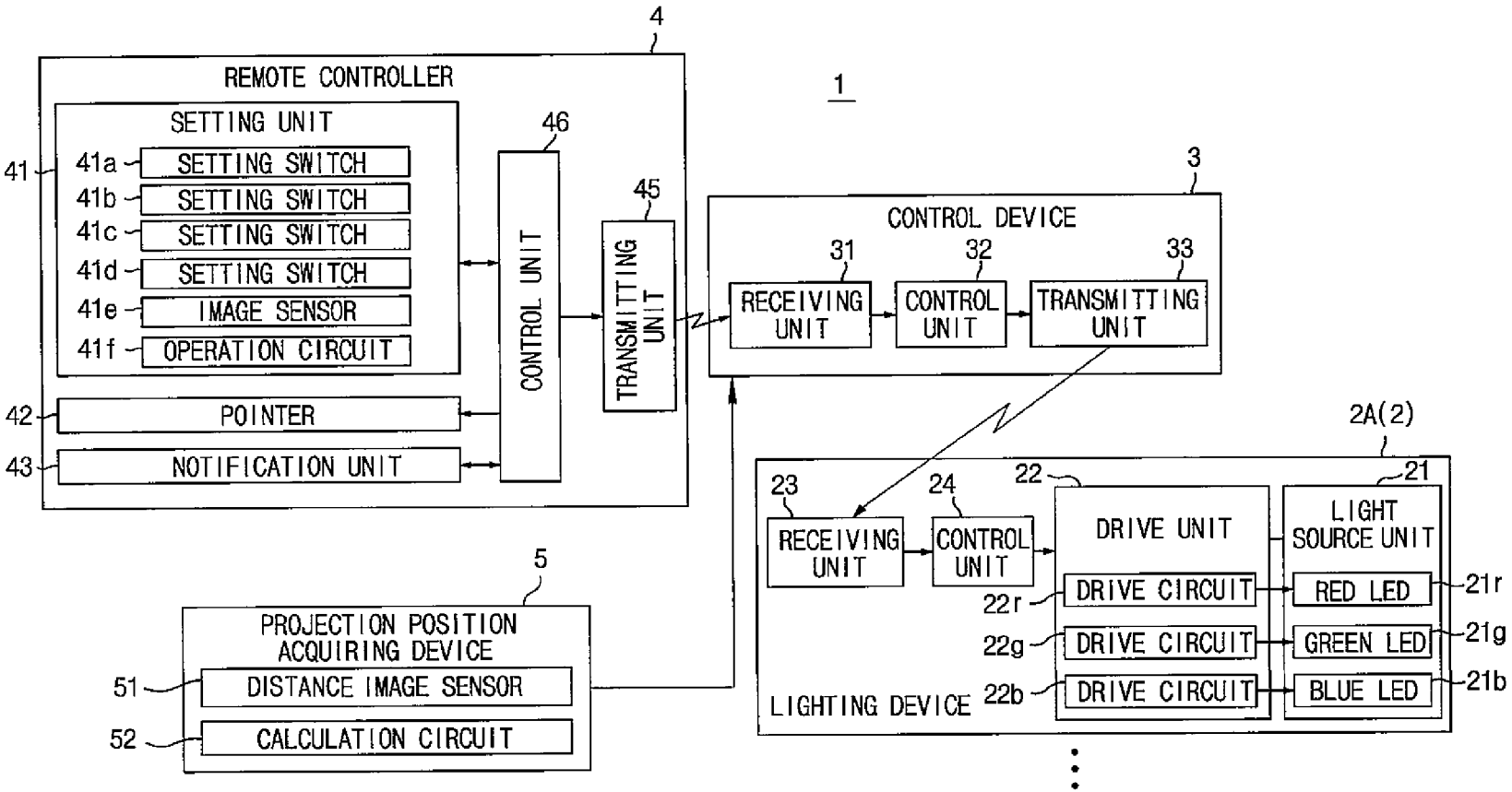
FIG. 10 is an electric block diagram of the illumination system shown in FIG. 9.

FIG. 10 shows the electric configuration of the illumination system 1 in accordance with the present modified example. The projection position acquiring device includes a distance image sensor 51 and a calculation circuit 52. The distance image sensor 51 images the laser light emitted from the pointer 42 and acquires a distance image indicative of the three-dimensional optical path of the laser light. The distance image sensor 51 is formed of a CCD sensor or the like. A wide-angle lens, a fish-eye lens or the like may be used as a lens of the distance image sensor 51. The CCD sensor includes a plurality of photodiodes. The photodiodes are arranged in a corresponding relationship with the respective pixels in the image formation position of an optical system. If the laser light emitted from the pointer 42 has a red color, it is preferred that a sensor capable of receiving infrared light be used as the CCD sensor. If the laser light has a blue color, it is preferred that a filter transmitting only the blue wavelength light be attached to the CCD sensor. The distance image sensor 51 may be formed of a CMOS sensor.

The calculation circuit 52 finds the relative positional relationship of the projection position P1 (see FIG. 9) of the laser light with respect to the distance image sensor 51 based on the distance image acquired by the distance image sensor 51. Based on the positional relationship thus found and the coordinates of the distance image sensor 51 in the arrangement space of the lighting devices 2 acquired in advance, the calculation circuit 52 calculates the coordinates of the projection position P1 in the arrangement space.

The projection position acquiring device 5 may be provided independently of the control device 3 to make wireless communications or wire communications with the control device 3 or may be mounted in the control device 3. Since the projection position acquiring device 5 is provided independently of the remote controller 4, the control unit 32 of the control device 3 obtains the three-dimensional coordinates of the projection position P1 of the laser light without going through the transmitting unit 45 of the remote controller 4.

In the present modified example, the projection position information of the laser light is acquired by the projection position acquiring device 5. Therefore, the projection position acquiring unit 44 for acquiring the projection position information may be omitted from the remote controller 4. This makes it possible to reduce the size of the remote controller 4 and to reduce the load applied to the remote controller 4. It is also possible to reduce the power consumption in the remote controller 4 and to reduce the capacity and size of the battery.

Third Modified Example

Figure 11:
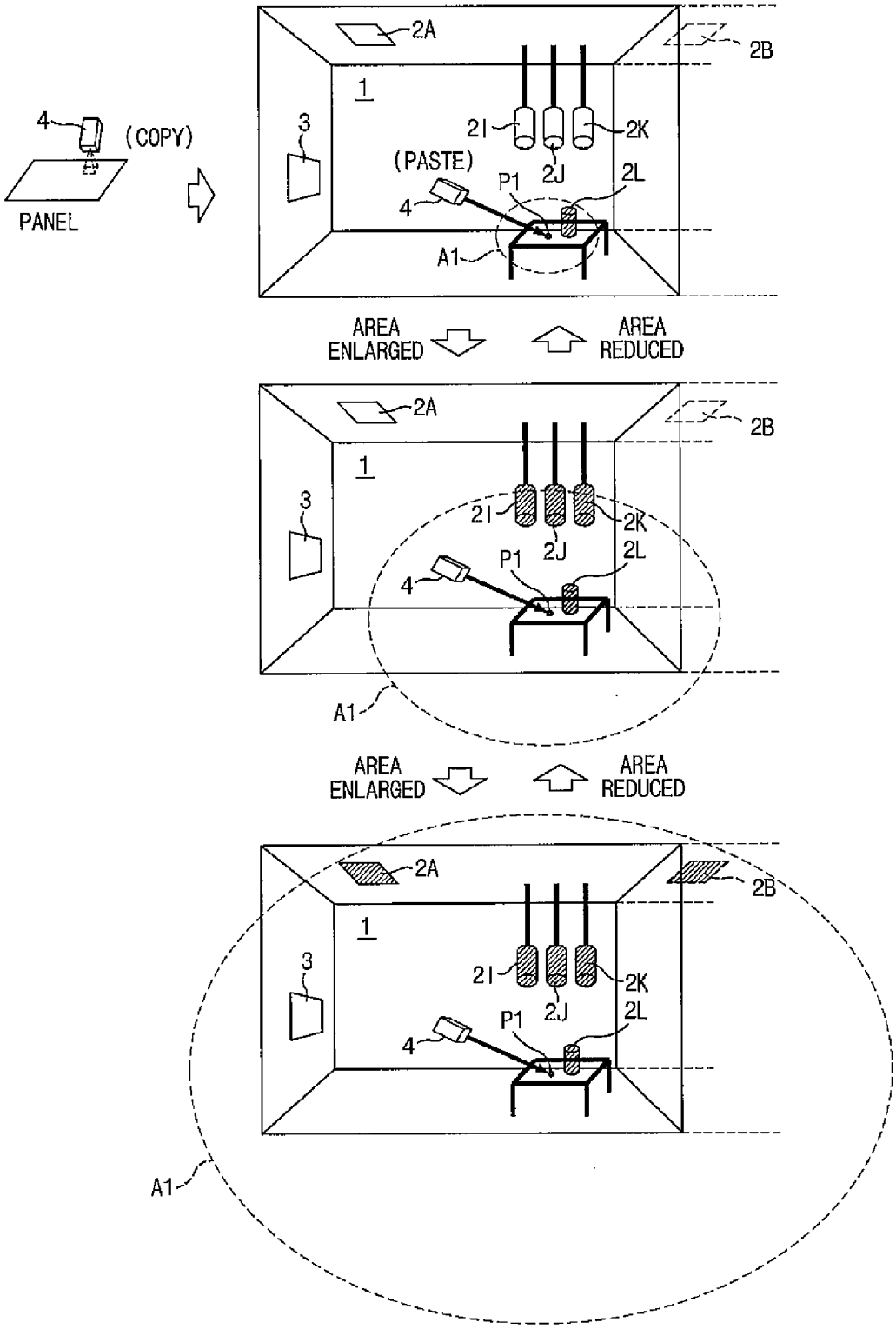
FIG. 11 is a one-point perspective projection view showing an illumination system in accordance with a third modified example of the first embodiment.

An illumination system in accordance with a third modified example will now be described with reference to FIGS. 2 and 11. FIG. 11 shows the configuration of an illumination system 1 in accordance with a third modified example. In the present modified example, the control unit 32 of the control device 3 selects, as control targets, the lighting devices 2 existing within a selection area A1 determined on the basis of the projection position P1 of the laser light. The selection area A1 is a three-dimensionally widening area having, e.g., a spherical shape. The lighting devices 2 are formed of hanging type lighting devices 21 to 2K and a desktop type lighting device 2L in place of the lighting devices 2C to 2H.

The setting switch 41*b* of the remote controller 4 is configured to interchange a selection area changing mode, in which the selection area A1 can be enlarged or reduced, with other modes. In a state that the remote controller 4 is switched to the selection area changing mode by the operation of the setting switch 41*b*, the setting switch 41*a* (the area changing operation unit) serves as a switch for enlarging or reducing the selection area A1. By changing the rotational operation direction of the setting switch 41*a*, it is possible to enlarge or reduce the selection area A1. Depending on the rotational operation amount of the setting switch 41*a*, it is possible to change the enlarging ratio and the reducing ratio of the selection area A1. The control unit 46 generates area changing information indicative of the content of the changing operation of the selection area A1 performed by the setting switch 41*a*. The transmitting unit 45 wirelessly transmits the area changing information to the control device 3.

In the control device 3, the receiving unit 31 receives the area changing information wirelessly transmitted from the transmitting unit 45. Based on the area changing information received by the receiving unit 31, the control unit 32 selects, as control targets, the lighting devices 2 existing within the changed selection area A1. The control unit 32 recognizes the selection area A1 as a space expanding about the projection position coordinates of the laser light. The control unit 32 selects, as control targets, the lighting devices 2 having position coordinates existing in the recognized space.

Figure 12:
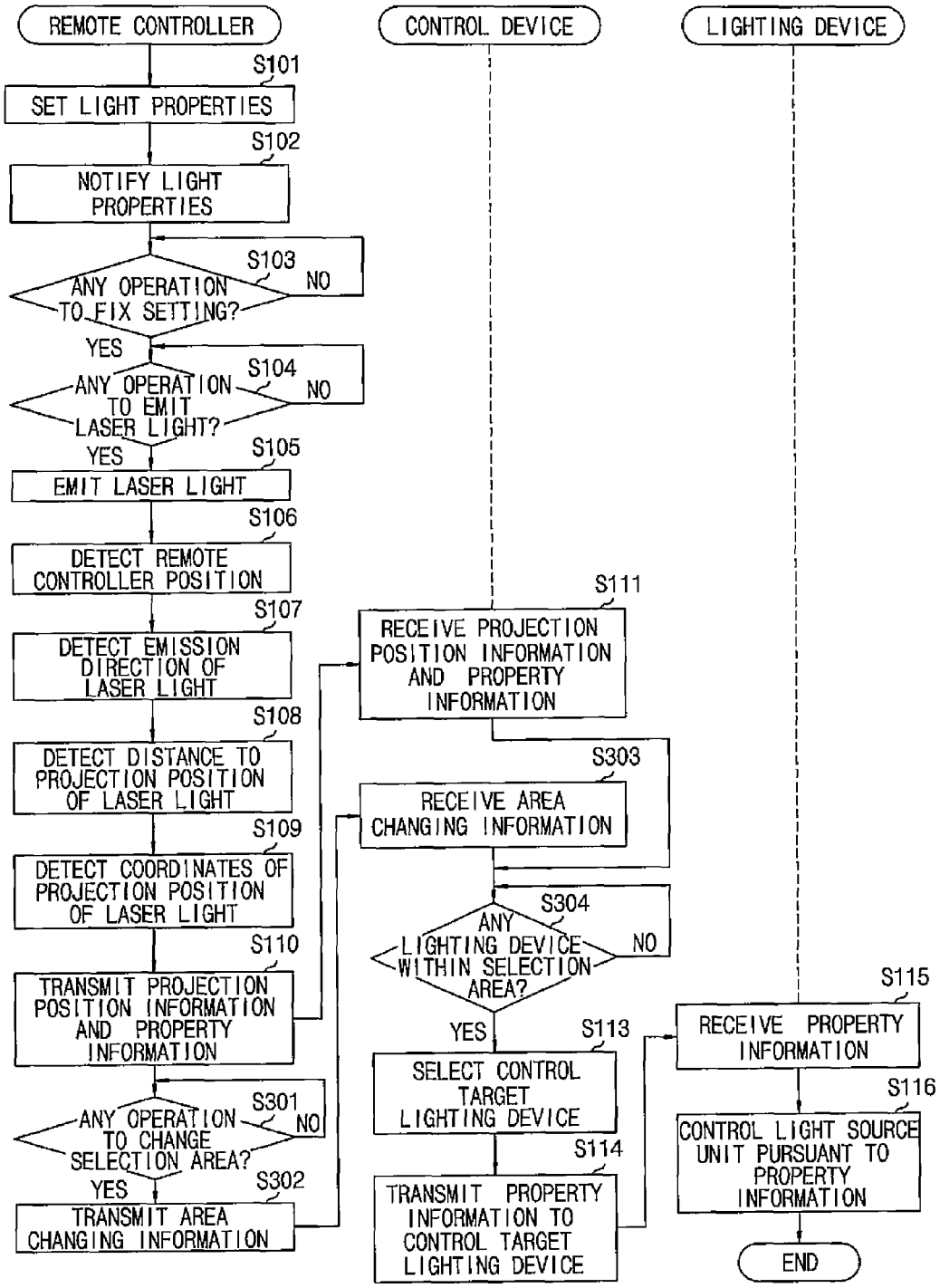
FIG. 12 is a flowchart illustrating an operational sequence of the illumination system shown in FIG. 11.

FIG. 12 shows an operational sequence of the illumination system 1 in accordance with the present modified example. In the sequence of the present modified example, as compared with the foregoing embodiment (see FIG. 3), steps S301 through S303 are added and step S112 is changed to step S304. In the present modified example, if the setting switch 41*a* is operated to change the selection area A1 (if Yes in S301), the transmitting unit 45 transmits the area changing information to the control device 3 (S302). Then, the receiving unit 31 of the control device 3 receives the area changing information (S303).

The control unit 32 of the control device 3 determines whether or not the lighting devices 2 are included in the selection area A1. If it is determined that the lighting devices 2 are included in the selection area A1 (if Yes in S304), the control unit 32 selects the lighting devices 2 as control targets. When the receiving unit 31 receives the area changing information, the control unit 32 selects the lighting devices 2 based on the changed selection area A1.

In the present modified example, a plurality of lighting devices 2 can be collectively selected as control targets by appropriately setting the selection area A1. This makes it possible to reduce the time required in the selection operation. In addition, the lighting devices 2 existing around the projection position P1 of the laser light can be operated without having to direct the laser light of the remote controller 4 toward one of the lighting devices 2. This enhances the usability.

Even if the lighting devices 2 are dispersedly arranged in a plurality of rooms, it is possible to collectively select the lighting devices 2 of different rooms as control targets. For that reason, there is no need to enter the respective rooms in order to operate the lighting devices 2 of different rooms. This makes it convenient to operate the lighting devices 2.

In case of the foregoing embodiment, if new lighting devices 2 are additionally installed, it is necessary to perform a setting by which the new lighting devices 2 can communicate with the control device 3. It is also necessary to input the position coordinates of the new lighting devices 2 to the control device 3 and to set section data on the basis of the new lighting devices 2. In the present modified example, however, there is no need to set any section data. This makes it easy to perform setting work.

Fourth Modified Example

Figure 13:
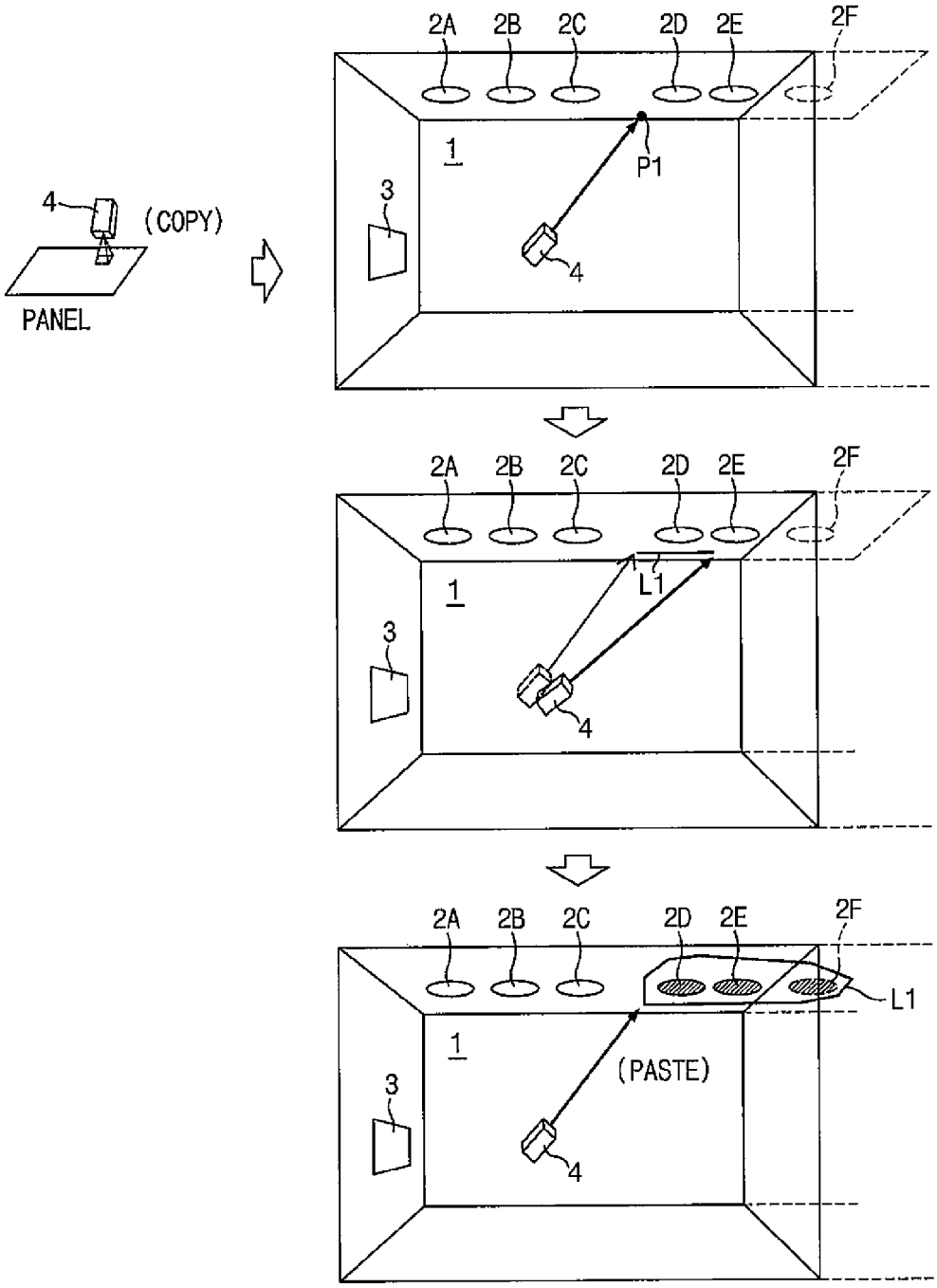
FIG. 13 is a one-point perspective projection view showing an illumination system in accordance with a fourth modified example of the first embodiment.

FIG. 13 shows the configuration of an illumination system 1 in accordance with a fourth modified example. In the present modified example, if the locus L1 of the projection position P1 of the laser light forms a closed curve, the control unit 32 of the control device 3 selects, as control targets, the lighting devices 2 existing within a space surrounded by the closed curve when seen from the remote controller 4. The control unit 32 selects, as control targets, the lighting devices 2 existing in a conical space having an apex positioned in a specified portion of the remote controller 4 and an outer circumference surrounded by the closed curve. The lighting devices 2A to 2F are arranged along a line.

Figure 14:
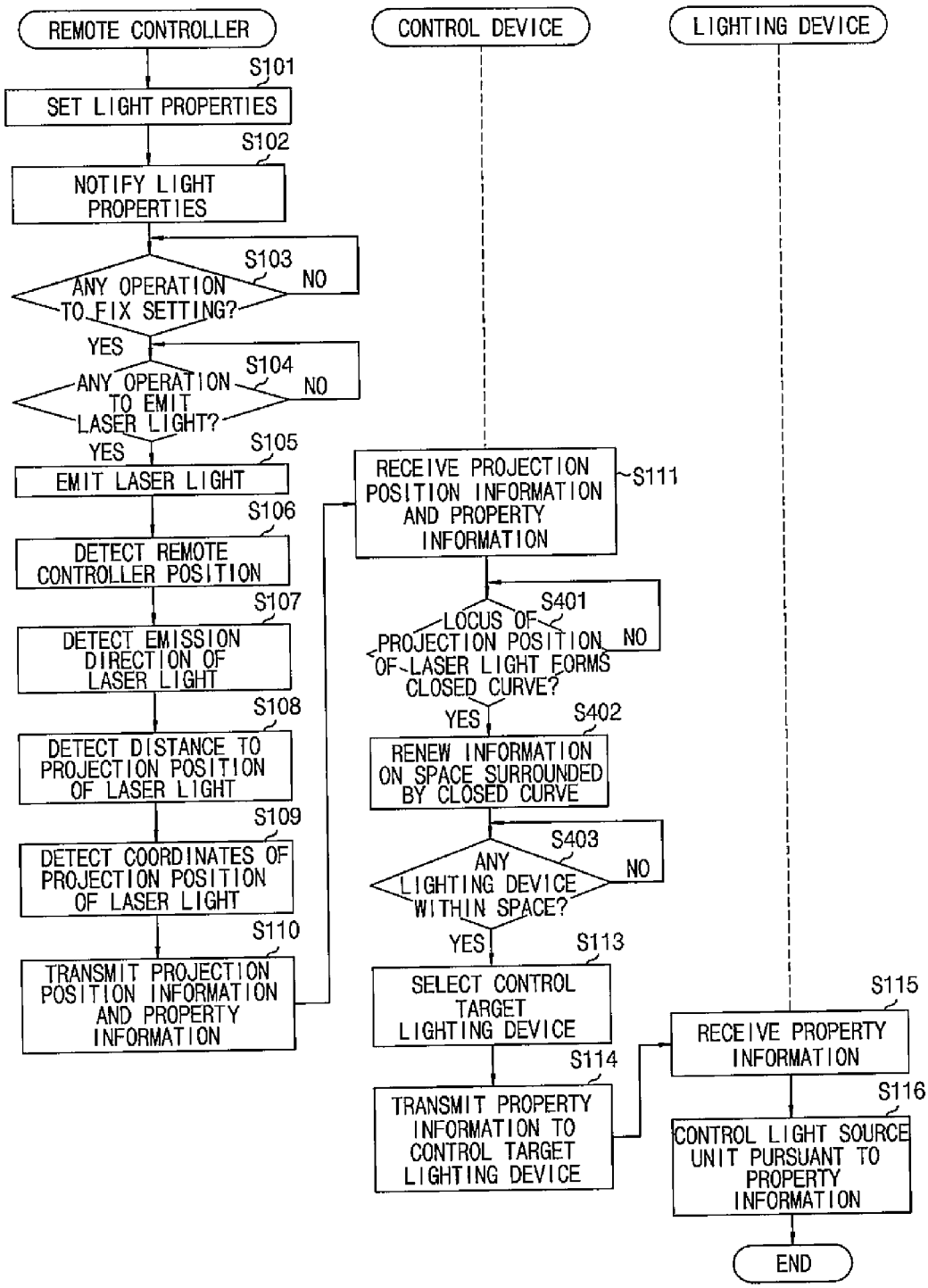
FIG. 14 is a flowchart illustrating an operational sequence of the illumination system shown in FIG. 13.

FIG. 14 shows a sequence of the illumination system 1 in accordance with the present modified example. In the present modified example, as compared with the foregoing embodiment (see FIG. 3), step S112 is changed to steps S401 to S403. In the present modified example, based on the projection position coordinates of the laser light, the control unit 32 determines whether or not the locus L1 of the projection position (see FIG. 13) forms a closed curve. If it is determined that the locus L1 forms a closed curve (if Yes in S401), the control unit 32 renews the information on the space surrounded by the closed curve when seen from the remote controller 4 (S402). Thereafter, the control unit 32 determines whether or not the lighting devices 2 are included in the space. If it is determined that the lighting devices 2 are included in the space (if Yes in S403), the control unit 32 selects the lighting devices 2 as control targets.

In the present modified example, by merely moving the remote controller 4 so that the laser light can describe a closed curve surrounding the lighting devices 2, it is possible to select the lighting devices 2 within the closed curve as control targets. This makes it easier to perform the selection operation. In particular, if there is a plurality of lighting devices 2 to be controlled, the lighting devices 2 can be collectively selected as control targets by moving the laser light to surround the lighting devices 2. Accordingly, the lighting devices 2 can be selected as control targets without having to point the lighting devices 2 one by one. This makes it easy to perform the selection operation.

Fifth Modified Example

Figure 15:
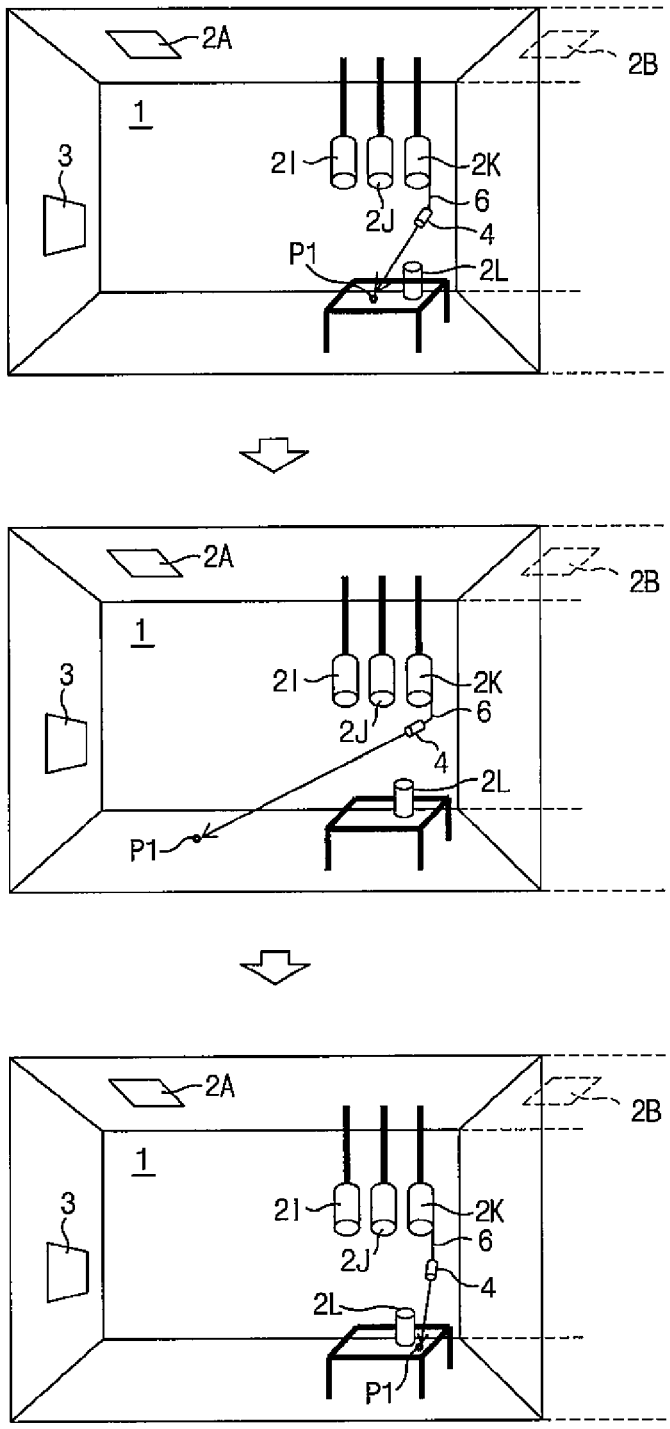
FIG. 15 is a one-point perspective projection view showing an illumination system in accordance with a fifth modified example of the first embodiment.
Figure 16:
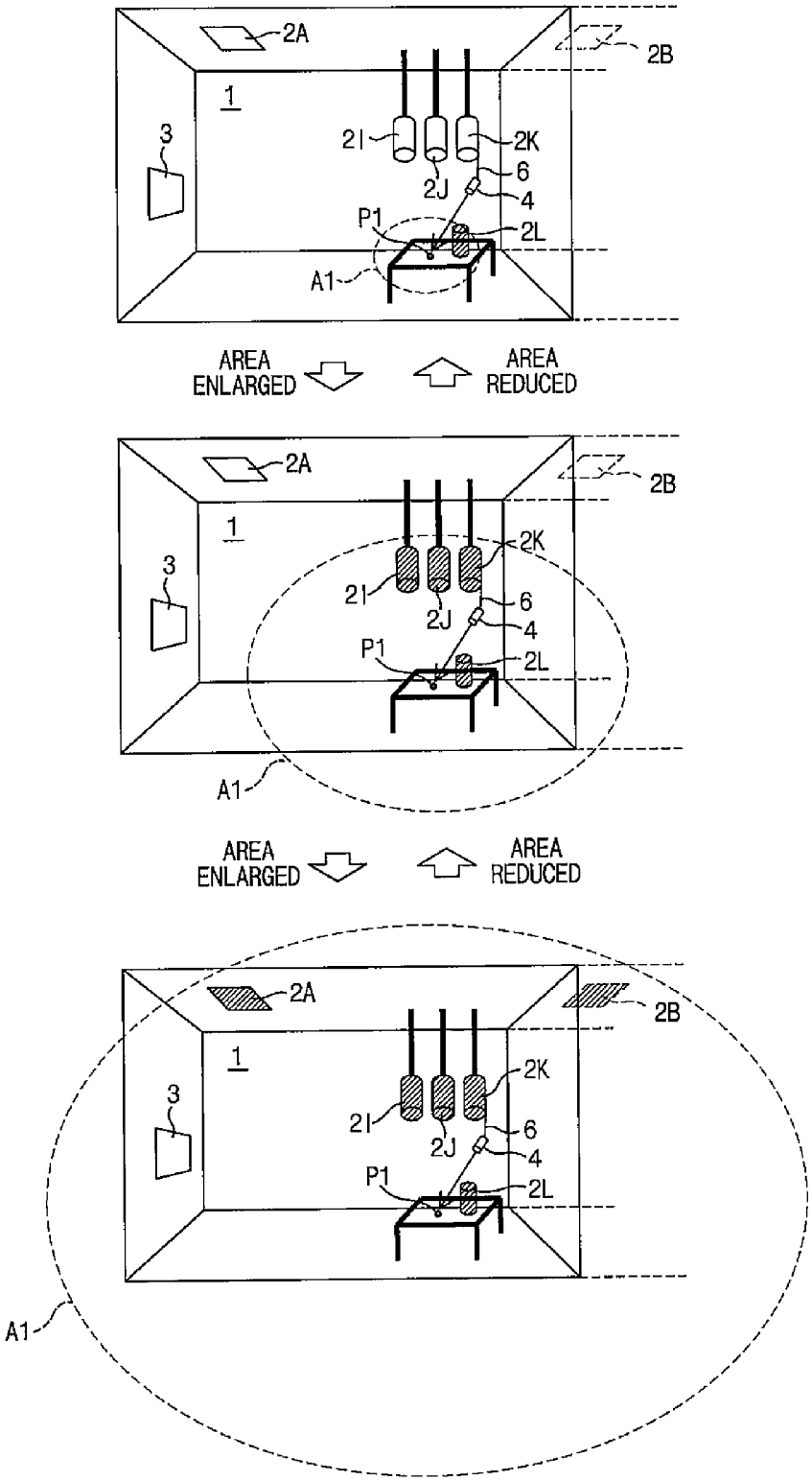
FIG. 16 is a one-point perspective projection view showing a use example of the illumination system shown in FIG. 15 in a chronological order.

FIG. 15 shows the configuration of an illumination system 1 in accordance with a fifth modified example. In the illumination system 1 of the present modified example, as compared with the third modified example, the remote controller 4 is attached to one end of a deformable member 6. The other end of the deformable member 6 is connected with the lighting device 2K. The deformable member 6 is preferably deformable in three directions orthogonal with each other. As shown in FIG. 16, just like the third modified example, the illumination system 1 of the present modified example is configured to select control targets depending on whether the lighting devices 2 are included in the selection area A1 and is configured to change the selection area A1.

The configuration of the remote controller 4 of the present modified example will now be described with reference to FIG. 2. In the present modified example, the remote controller position detecting circuit 44*a* includes a circuit for detecting the position coordinates of the remote controller 4 in response to the deformation of the deformable member 6. Instead of the near-infrared LED 44*f* and the distance image sensor 44*g*, the circuit finds the position coordinates of the remote controller 4. Based on the deformation of the deformable member 6, the circuit finds the relative positional relationship of the remote controller 4 with respect to the lighting device 2K. The circuit measures the position coordinates of the remote controller 4 from the positional relationship thus found and the position coordinates of the lighting device 2K stored in advance. The sequence of the present modified example remains the same as that of the third modified example.

In the present modified example, as compared with the third modified example, it is possible to simplify the configuration of the remote controller position detecting circuit 44*a* and to reduce the manufacturing cost. Since the remote controller position detecting circuit 44*a* measures the position coordinates of the remote controller 4 based on the fixed position coordinates of the lighting device 2K, it is possible to increase the measurement accuracy of the position coordinates of the remote controller 4.

The present invention is not limited to the configurations of the embodiment and modified examples described above but may be modified in many different forms depending on the intended use. For example, one of the respective modified examples may be combined with others.

The communications between the lighting devices 2 and the control device 3 may be made through a wire. In that case, the communications may be the communications complying with the standard of DALI (Digital Addressable Lighting Interface), the communications making use of a wire LAN, or the power line communications.

The light source unit 21 may be formed of three kinds of light emitting elements for generating the light of three primary colors that can be used in toning and dimming the composite light. Each of the light emitting elements may be formed of an organic EL element or an inorganic EL element. The lighting devices 2 may be formed of light sources incapable of toning light but capable of dimming light, e.g., fluorescent lamps, HID (High Intensity Discharge) lamps or incandescent lamps.

While the respective lighting devices 2 can independently adjust the color temperature and the light quantity of the emitted light, the psychological effect on a user varies with the light quantity (illuminance) even at the same color temperature. However, it is very difficult to appropriately adjust the color temperature and the light quantity, even if a user wants to obtain a desired psychological effect (Kruithof effect). In view of the Kruithof effect and a desire to realize a pleasant lighting environment in terms of the psychological effect, the characteristics of the light quantity being increased as the color temperature grows higher may be pre-stored in the memory of the control unit 24 as a conversion table. If the color temperature is fixed, the light quantity of each of the light emitting element corresponding to the color temperature can be unambiguously determined by referring to the conversion table.

Particularly, in the region of low color temperature (in the region of about 2800 K or less indicating the light color of an incandescent lamp), it is preferable to simulate the characteristics of the color temperature and the light quantity obtainable when dimming an incandescent lamp. In the region of middle color temperature and high color temperature, the light quantity may be increased as the color temperature rises. For typical lighting purposes, it is sufficient to obtain the light quantity substantially equal to a rated light quantity. Therefore, increasing the light quantity beyond the rated light quantity is undesirable from the viewpoint of saving energy.

Accordingly, it is preferred that the light quantity be kept constant in the region of specified color temperature (e.g., 2800 K or more). In the region of high color temperature, it is necessary to increase the light quantity ratio of the LED 21*b* among the LEDs 21*r*, 21*g* and 21*b*. However, due to the characteristics thereof, the LED 21*b* is lower in light emission efficiency than the remaining LEDs 21*r* and 21*g*. For that reason, it may be difficult to increase the color temperature of the composite light while keeping the light quantity of the composite light constant. It is therefore preferred that, in the region of specified color temperature (e.g., 2800 K or more), the light quantity be reduced as the color temperature grows higher.

In the remote controller 4, the operation information may be inputted to the setting unit 41 so that it indicates an increase in the parameters of the light properties if a user rotates the remote controller 4 to the right and a decrease in the parameters of the light properties if a user rotates the remote controller 4 to the left. The remote controller 4 may be arranged near the movable lighting device 2. When a specific operation is made in the remote controller 4, the remote controller 4 may transmit the current position coordinates to the control device 3. The control device 3 may acquire the current position coordinates as the position coordinates of the movable lighting device 2.

From the viewpoint of usage convenience, the remote controller 4 may be a pen type as a kind of pointer devices. The remote controller 4 may be applied to a cellular phone, a smart phone, a remote controller for games, a digital camera, a PDA (Personal Digital Assistant) or a portable music player. In addition, the remote controller 4 may be applied to portable lighting devices represented by a lantern torch or a portable clock such as a wristwatch.

The setting unit 41 may be provided with a switch for instructing a flickering operation as a kind of the light properties, and a switch for inputting the position coordinates of the movable lighting device 2. These switches and the setting switches 41*a* to 41*d* may be slide-type switches, push button switches or touch panels. In either case, the slide operation distance, the push operation time or the finger movement distance on the touch panel is recognized as a parameter indicative of the operation content.ajf The notification unit 43 may be configured to notify various kinds of information on the lighting devices 2.

In the remote controller position detecting circuit 44*a*, visible light, ultrasonic waves, electric waves or the combination thereof may be used to measure the distance of signal waves. In this case, depending on the kinds of the signal waves used, a visible light LED, an ultrasonic wave oscillation circuit, an electric wave transmitting circuit or the combination thereof may be used as a signal wave transmitting medium. Depending on the kinds of the signal waves transmitted, a visible light image sensor, an ultrasonic wave sensor, an electric wave sensor or the combination thereof may be used as the distance image sensor.

The posture detecting circuit 44*b* may be formed of a gyro sensor that detects changes in angular velocity caused by the change of the posture of the remote controller 4. By adding up the changes, it is possible to specify the azimuth angle and the inclination angle of the remote controller 4. Examples of the gyro sensor include a gas-rate gyro sensor, a rotary gyro sensor, a vibrating structure gyro sensor and a fiber optical gyro sensor. A plurality of gyro sensors may be provided in the remote controller 4.

In the first modified example, one of the LEDs 21*r*, 21*g* and 21*b* may be turned on pursuant to the modulating signal, whereby the visible light can be modulated by the modulating signal. As a modulation protocol, it is preferred that the average light quantity per unit time of an LED be kept substantially constant. This configuration and the configuration of the first modified example may be employed and a valid configuration may be changed over between them. If the light quantity of the lighting devices 2 is equal to or larger than a threshold value, the former configuration may be made valid. If the light quantity of the lighting devices 2 is smaller than the threshold value, the latter configuration may be made valid.

Only some of the lighting devices 2 may be configured to transmit the current property information. In the second modified example, a plurality of distance image sensors 51 may be provided so that the distance image sensors 51 can detect the laser light over a broader range than when there is provided a single distance image sensor. An all-round imaging sensor capable of imaging the view of substantially all azimuth angles, 360 degrees, may be used as the distance image sensor 51. In the fifth modified example, the remote controller 4 may be attached to a fixed electronic device other than the lighting device 2K.

While the invention has been shown and described with respect to the embodiments, it will be understood by those skilled in the art that various changes and modification may be made without departing from the scope of the invention as defined in the following claims.

What is claimed is:

1. An illumination system, comprising:

a plurality of lighting devices;

a control device for controlling the lighting devices;

a remote controller for remotely setting a control content to be performed by the control device; and a projection position acquiring unit, wherein the remote controller includes:

a light property setting unit for setting a light property of a control target lighting device among the lighting devices;

a pointer for emitting visible light to illuminate and point the control target lighting device; and a remote controller transmitting unit for wirelessly transmitting property information indicative of the light property set by the light property setting unit to the control device, wherein the projection position acquiring unit acquires projection position information indicative of a projection position of the visible light emitted from the pointer, wherein the projection position information is transmitted to the control device, wherein the control device includes:

a control device receiving unit for receiving the property information and the projection position information;

a lighting device selecting unit for selecting the control target lighting device based on the projection position information received by the control device receiving unit and lighting device position information acquired in advance; and a control device transmitting unit for transmitting the property information received by the control device receiving unit to the control target lighting device selected by the lighting device selecting unit, and wherein each of the lighting devices includes:

a lighting device receiving unit for receiving the property information transmitted from the control device transmitting unit; and a lighting device control unit for controlling a light source of each of the lighting devices based on the property information received by the lighting device receiving unit.

2. The system of claim 1, wherein the light property setting unit includes an imaging unit for imaging a sample having a light property or an information code indicative of a light property, and the light property setting unit is configured to obtain the light property by analyzing an image obtained by the imaging unit and to set the obtained light property as the light property of the control target lighting device.

3. The system of claim 1, wherein at least one of the lighting devices includes a lighting device transmitting unit for wirelessly transmitting current property information indicative of a current light property of said at least one of the lighting devices to the remote controller, the remote controller includes a remote controller receiving unit for receiving the current property information wirelessly transmitted from the lighting device transmitting unit, and the light property setting unit is configured to set the light property indicated by the current property information received by the remote controller receiving unit as a light property of another control target lighting device.

4. The system of claim 2, wherein the remote controller further includes a setting adjustment unit for adjusting the content of the light property set by the light property setting unit.

5. The system of claim 1, wherein the projection position acquiring unit is provided within the remote controller and the remote controller transmitting unit wirelessly transmits the projection position information acquired by the projection position acquiring unit to the control device, and wherein the projection position acquiring unit has:

a remote controller position detecting unit for detecting the position of the remote controller;

a direction detecting unit for, based on the posture of the remote controller, detecting the emission direction of the visible light emitted from the pointer; and a distance measuring unit for, based on the light reflected from a projection object of the visible light, measuring a distance from the remote controller to the projection position of the visible light, wherein the projection position acquiring unit is configured to recognize a position which is moved forward from the position of the remote controller detected by the remote controller position detecting unit in the emission direction detected by the direction detecting unit by the distance measured by the distance measuring unit, as the projection position of the visible light.

6. The system of claim 1, wherein the projection position acquiring unit is provided separately from the remote controller, the projection position acquiring unit including a distance image sensor for imaging the visible light to acquire a distance image indicative of a three-dimensional optical path of the visible light, the projection position acquiring unit is configured to find the relative positional relationship of the projection position of the visible light with respect to the distance image sensor based on the distance image acquired by the distance image sensor and to calculate the three-dimensional coordinates of the projection position in an arrangement space of the lighting device based on the relative positional relationship thus found and the pre-acquired three-dimensional coordinates of the distance image sensor in the arrangement space of the lighting device, and the lighting device selecting unit is configured to acquire the three-dimensional coordinates of the projection position calculated by the projection position acquiring unit without going through the remote controller transmitting unit.

7. The system of claim 1, wherein the lighting device selecting unit is configured to select, as a control target, the lighting device existing within a selection area determined on the basis of the projection position of the visible light.

8. The system of claim 7, wherein the remote controller includes an area changing operation unit for enlarging or reducing the selection area, the remote controller transmitting unit is configured to wirelessly transmit area changing information indicative of the content of the selection area changing operation performed by the area changing operation unit to the control device, the control device receiving unit is configured to receive the area changing information wirelessly transmitted from the remote controller transmitting unit, and the lighting device selecting unit is configured to select, as the control target, the lighting device existing within the changed selection area based on the area changing information received by the control device receiving unit.

9. The system of claim 1, wherein, when a locus of the projection position of the visible light forms a closed curve, the lighting device selecting unit is configured to select, as a control target, the lighting device existing within a space surrounded by the closed curve when seen from the remote controller.

10. The system of claim 3, wherein the remote controller further includes a setting adjustment unit for adjusting the content of the light property set by the light property setting unit.

* * * * *